US012631429B2

(12) United States Patent
Oostvogel

(10) Patent No.: US 12,631,429 B2
(45) Date of Patent: May 19, 2026

(54) BALLISTIC SHIELD

(71) Applicant: POINTMAN ARMOR CONCEPTS B.V., Amsterdam (NL)

(72) Inventor: Abraham Alexander Frederic Oostvogel, Amsterdam (NL)

(73) Assignee: POINTMAN ARMOR CONCEPTS B.V., Amsterdam (NL)

( * ) Notice: Subject to any disclaimer, the term of this patent is extended or adjusted under 35 U.S.C. 154(b) by 0 days.

(21) Appl. No.: 18/255,959

(22) PCT Filed: Dec. 8, 2021

(86) PCT No.: PCT/NL2021/050746
§ 371 (c)(1),
(2) Date: Jun. 5, 2023

(87) PCT Pub. No.: WO2022/124894
PCT Pub. Date: Jun. 16, 2022

(65) Prior Publication Data

US 2024/0044620 A1 Feb. 8, 2024

(30) Foreign Application Priority Data

Dec. 8, 2020 (NL) ..... 2027071
Apr. 15, 2021 (NL) ..... 2027979

(51) Int. Cl.
*F41H 5/08* (2006.01)

(52) U.S. Cl.
CPC ..... *F41H 5/08* (2013.01)

(58) Field of Classification Search
CPC ..... F41H 5/08
See application file for complete search history.

(56) References Cited

U.S. PATENT DOCUMENTS 1,649,996 A * 11/1927 Toth ..... F41H 5/08 2/2.5
4,674,394 A * 6/1987 Martino ..... F41H 5/08 2/2.5

(Continued)

FOREIGN PATENT DOCUMENTS

CN 2583608 Y 10/2003
CN 2859438 Y 1/2007

(Continued)

OTHER PUBLICATIONS

Stewart, J. "Ballistic Resistant Protective Materials", Sep. 1985, 16 pages, US United States National Institute of Justice Standard 0108.01.

(Continued)

*Primary Examiner* — Michelle Clement
(74) *Attorney, Agent, or Firm* — Steven M. Koehler; Westman, Champlin & Koehler, P.A.

(57) ABSTRACT

A protective shield comprises a shield body. The shield body comprises a shield panel having a first and second face defining a threat side in a threat direction and a protected side in a protected direction opposite the threat side and threat direction, respectively, and having opposite panel edges and an edging covering at least part of the panel edges. The shield body further comprises connectors for mounting, in particular removably mounting, one or more accessories to the shield body on the threat side. At least some of the connectors are arranged on the threat side and/or at least one of exposed and exposable on the threat side, and at least partly accommodated in the edging.

20 Claims, 15 Drawing Sheets

(56) References Cited

U.S. PATENT DOCUMENTS

| | | | | |
|---|---|---|---|---|
| 5,463,929 | A * | 11/1995 | Mejia | F41H 5/0457 109/82 |
| 6,807,890 | B1 * | 10/2004 | Fuqua | F41H 5/08 89/36.02 |
| 7,302,880 | B1 * | 12/2007 | Elasic | F41H 13/0087 89/36.01 |
| 7,716,748 | B2 * | 5/2010 | Dovner | F41C 33/0209 89/36.01 |
| 7,891,283 | B2 * | 2/2011 | Kleniatis | F41H 5/14 89/36.09 |
| 8,276,499 | B1 * | 10/2012 | Fuqua | F41H 5/14 89/929 |
| 8,584,571 | B2 * | 11/2013 | Armellino, Jr. | F41H 5/08 89/36.01 |
| 8,590,439 | B2 * | 11/2013 | White | F41H 5/24 89/36.01 |
| 8,671,820 | B1 * | 3/2014 | Keyfauver | F41H 5/08 89/918 |
| 9,360,280 | B2 * | 6/2016 | White | F41H 5/013 |
| 9,752,856 | B2 * | 9/2017 | Rashad | A01K 29/00 |
| 10,125,486 | B1 * | 11/2018 | Handley | E04H 9/06 |
| 10,281,244 | B2 * | 5/2019 | Spransy | F41H 5/08 |
| 10,281,245 | B2 * | 5/2019 | DeKort | F41H 5/24 |
| 10,352,660 | B2 * | 7/2019 | Trott | F41H 5/26 |
| 10,401,126 | B1 * | 9/2019 | Kolomijez | B43L 1/00 |
| 10,584,943 | B2 * | 3/2020 | Armellino, Jr. | F41H 5/08 |
| 11,340,044 | B1 * | 5/2022 | Fuerte | A62C 25/00 |
| 11,415,395 | B1 * | 8/2022 | Higgins, Jr. | F41H 5/08 |
| 11,519,699 | B1 * | 12/2022 | Kissinger | F21V 23/04 |
| 11,994,368 | B2 * | 5/2024 | Beck | F41H 5/013 |
| 12,038,257 | B2 * | 7/2024 | Johannes van Riel | F41H 5/24 |
| 12,201,208 | B1 * | 1/2025 | Stubbs | A44B 11/266 |
| 2007/0125224 | A1 * | 6/2007 | Thomas | F41H 5/08 89/36.07 |
| 2007/0283477 | A1 * | 12/2007 | Dovner | F41H 9/10 2/2.5 |
| 2007/0295199 | A1 * | 12/2007 | Elasic | F41H 13/0087 89/36.06 |
| 2010/0083820 | A1 | 4/2010 | Doyner et al. | |
| 2013/0098234 | A1 | 4/2013 | Armellino, Jr. | |
| 2017/0227334 | A1 * | 8/2017 | Peters | B65D 43/26 |
| 2018/0017360 | A1 | 1/2018 | Adamow et al. | |
| 2018/0120063 | A1 * | 5/2018 | Yakoub | F41H 5/08 |
| 2018/0202771 | A1 * | 7/2018 | Armellino, Jr. | F41H 5/08 |
| 2019/0145741 | A1 * | 5/2019 | Spransy | F41H 5/013 89/36.05 |
| 2019/0390941 | A1 | 12/2019 | Beck | |
| 2020/0378728 | A1 * | 12/2020 | DeCamp | B44F 1/00 |
| 2024/0044620 | A1 | 2/2024 | Oostvogel | |
| 2025/0052544 | A1 * | 2/2025 | Oostvogel | F41H 5/08 |

FOREIGN PATENT DOCUMENTS

| | | | |
|---|---|---|---|
| CN | 205373534 | U | 7/2016 |
| CN | 209802192 | U | 12/2019 |
| EP | 3587992 | A1 | 1/2020 |
| JP | 2005090930 | A | 4/2005 |
| WO | 2012027824 | A1 | 3/2012 |

OTHER PUBLICATIONS

International Search Report and Written Opinion for corresponding International application No. PCT/NL2021/050746 dated Mar. 10, 2022.

Office Action in corresponding Chinese Application Serial No. 202180093317.2 dated Nov. 21, 2025.

* cited by examiner

SECTION A-A

SECTION A-A

SECTION B-B

BALLISTIC SHIELD

CROSS-REFERENCE TO RELATED APPLICATION(S)

The present application is a § 371 national phase entry of International patent application Serial No. PCT/NL2021/050746, filed Dec. 8, 2021, and published in English, and claims priority from Netherlands application no. 2027071 filed on Dec. 8, 2020 and Netherlands application no. 202797 filed on Apr. 15, 2021.

TECHNICAL FIELD

The present disclosure relates to protective shields, in particular to ballistic shields, more in particular to hand-held ballistic shields.

BACKGROUND

Protective shields are known for millennia as useful defence devices to provide protection on a protected side (or: rear side) against force and/or impact from a threat side (or: front side). In modern days, shields are predominantly used by law enforcement and/or (para-) military units, e.g. as riot shields or ballistic shields. Ballistic shields have been developed for defence against bullets, similar projectiles and/or shrapnel. Typically, ballistic shields may be classified into distinct levels of protection.

As a result, different aspects of ballistic shields are known. E.g. US 2010/0083820 discloses a ballistic shield with lighting and a power source; US 2007/0283477 discloses a ballistic shield having a rear surface upon which a fastening combination may be provided for accepting at least one accessory; and US 2007/295199 discloses a ballistic shield with an integral firearm.

Important considerations for (use of) ballistic shields may be conflicting and comprise, amongst others and not necessarily in this order: projectile impact resistance, weight, size, manoeuvrability, robustness (in general use, e.g. other than projectile impact resistance) and provision of subsystems and/or accessories like lamps, cameras, power supplies, offensive devices, etc.

Further improvements in shields, in particular ballistic shields addressing the above are therefore always desired.

SUMMARY

Herein is provided a protective shield body comprising a shield panel having a first and second face defining a threat side in a threat direction and a protected side in a protected direction opposite the threat side and threat direction, respectively, and having opposite panel edges and an edging covering at least part of the panel edges. The shield body further comprises connectors for mounting, in particular removably mounting, one or more accessories to the shield body on the threat side, in particular using mating counterconnectors. Further, at least some of the connectors are arranged on the threat side and/or at least one of exposed and exposable on the threat side, and being at least partly accommodated in the edging.

The shield panel provides the protective shield function. The shield panel may be flat (planar) or at least partly bent in one or more directions, e.g. being concave or biconcave. An at least partly bent shape, which may be mono- or polygonal or at least partly smoothly curved, may provide protection in plural threat directions. The edges may provide any suitable perimeter shape, whether regular or irregular, to the shield panel to provide an accordingly shaped shield body. The shield may have any suitable size.

A ballistic shield panel may be bullet proof for small calibre ammunition such as from handguns and/or rifles. The panel may be of a type as classified in any one of five types (IIA, II, IIIA, III, or IV, respectively) by level of ballistic performance under US United States National Institute of Justice Standard-0108.01, "Ballistic Resistant Protective Materials" (September 1985), or a comparable type.

The panel may have any suitable construction. For instance, the panel may comprise one or more layers of one or more of metal, glass, ceramic materials, polymeric material, such as polyacrylics, polyethylene, aramide, any of which possibly fixed together by one or more suitable adhesives and/or binders. The first and/or second face may be at least partly covered with a surface layer such as a paint and/or textile layer, for purposes of one or more of signalling, appearance, cleaning, weather resistance and wear resistances.

The edging covers at least part of the edges. The edging provides protection against damage of the shield panel edges. Such damage may comprise one or more of denting, chipping, delamination, liquid damage in particular due to water and/or oils. In particular, the edging may be at least partly resilient. The edging may comprise or be essentially of one or more of natural rubber and/or a synthetic rubber, a polyurethane-material, a silicone-material.

The connectors facilitate mounting and release of suitable accessories onto/from the shield body on and/or towards the threat side. The connectors may enable doing so without affecting the shield panel and/or the edging. The connectors and mating counterconnectors may facilitate selection of accessories and/or ensure sufficiently strong mounting to prevent damage and/or loss of the accessory and/or of the shield body during mounting and/or during use of an assembly of the shield body and one or more accessories mounted to it. The connectors may comprise or be at least partly of a different material than the shield body and/or the edging; this may e.g. address different forces and/or types of wear than the shield body and/or edging. In particular, the connectors may be at least in part of a metal and/or a polymeric material.

Also or instead of mated counterconnectors, an accessory itself may be, at least in part, be mated to at least part of the connector and/or have a shape complementary to at least part of the shield body; e.g. comprising a recess to accommodate at least part of the shield body.

Removable mounting facilitates repair and/or replacement of accessories. The connectors may be arranged less than about 7.5 cm (or 3 inches) from an edge of the panel, preferably less about 5 cm (or 2 inches) or even less than about 2.5 cm (or 1 inch). In some embodiments, the connector may be arranged at least partly protruding from the shield panel, however being at least partly accommodated in the edging. In case of mounting accessories to a ballistic panel using holes drilled through a ballistic panels, large and heavy-weight plates and bolts must normally be used to counter and offset local ballistic strength reductions due to the holes. It is noted that ballistic protection properties of a ballistic panel may decrease towards the edges and likewise towards interior edges formed by holes. This may be exacerbated by stress of mounting accessories directly onto the shield panel, in particular in case of drilling holes into the shield panel. The provision of connectors may obviate such holes and/or may reduce or prevent such stress on or in the panel.

The connectors being at least partly accommodated in the edging provides protection to at least part of one or more of the connectors, the shield panel, an accessory mounted to one or more of the connectors, the edging and a user of the shield body. E.g., by the accommodation, protrusion of the connector from the shield body may be reduced or prevented at least in part. Also or alternatively, the edging may assist fixing the connectors to the shield panel.

The connectors may preferably extend substantially parallel to and/or tangential to the first and/or second face of the shield panel at least at the location of the respective connector, reducing volume of the shield body. Also or alternatively, the connectors may preferably not extend from the panel beyond the edging and/or may preferably not extend from the panel beyond a perimeter of the shield body defined by the edging. This may reduce or prevent the connectors getting caught behind a further object.

The shield body may further comprise connectors for removably mounting one or more accessories to the shield body on the protected side, in particular using mating counter-connectors, being arranged on the protected side and/or at least one of exposed and exposable on the protected side, and being at least partly accommodated in the edging. This facilitates mounting further accessories on the protected side.

At least some of the connectors may be arranged at or near laterally opposite panel edges. Thus one or more accessories may be mounted on opposite sides of the shield body which may improve balance of the thus-formed assembly of shield body and accessories.

Also or alternatively, an expansion bracket may be mounted to the shield body traversing the shield body from one of the connectors to another one of the connectors at or near the laterally opposite panel edges. This may facilitate mounting further accessories onto the shield body and/or it may facilitate placement of an accessory on the shield body relative to the shield edges. In particular, the connectors at or near laterally opposite panel edges may be arranged on a line across one of the first or second faces of the shield panel perpendicular to a main axis and/or centre line of the shield body. The axis may e.g. be bending axis and/or a symmetry axis.

In the shield body, a plurality of the connectors, preferably all connectors, may be substantially identical. This may facilitate one or more of design and manufacture of the shield body, inventory and freedom of placement of accessories and/or counterconnectors.

At least some of the connectors may comprise a threaded portion for a screw connection and/or bayonet connection with a mated screw counterconnector and/or bayonet counterconnector. A screw- or bayonet connection combines robustness with ease of connection and disconnection. It also provides fixation in three mutually perpendicular directions.

A plurality of the connectors may be arranged in groups of connectors separated by relatively small distances, the groups of connectors being separated by relatively large distances. This may facilitate providing particular arrangements of accessories. Further, an accessory may be mounted to plural connectors or groups of connectors for increased robustness.

A plurality of the connectors may be attached to each other as an object attached to the panel and to the edging, e.g. being integrated in such object. In particular, a plurality of the connectors may be formed as, or be connected by, a strip along at least part of the edges. This may increase robustness of the connectors and it may spread loads on the ballistic panel thus reducing local stress.

At least part of at least some of the connectors may be formed as a rail. This may increase flexibility of placement of an accessory.

The panel may be devoid of holes into and/or through the panel, in particular in the first and/or second face, in particular holes associated with a connector and/or attachment of a connector. Thus, the shield panel may be (left) intact and a (relative) weakness of the panel due to a hole, either a blind hole or a through hole, may be prevented. In some cases a hole for a (bullet proof) window may be provided in the panel. In such case, the panel may be devoid of further holes into and/or through the panel as just described.

At least some of the connectors may be fixed onto the panel prior to providing the edging. This may facilitate manufacturing of the shield body and/or increase robustness of the shield body. The fixation may comprise clamping onto the panel. Also or alternatively gluing and/or welding etc. may be used.

At least some of the connectors may be releasably attached onto the panel. This may facilitate exchange and/or repair, in particular in case the edging is releasably attached to the panel.

A plurality of the connectors on and/or towards the threat side and connectors on and/or towards the protected side may be in register with each other in a direction normal to the first face and/or the second face of the panel. This may facilitate mounting accessories aligned to each other and/or providing balance to the shield.

The shield body may comprise at least one cable extending from the protected side to the threat side along an edge of the panel for transferring power and/or a signal such as a sensor signal between the protected side and the threat side. Also or alternatively, the shield body may comprise at least one conduit extending from the protected side to the threat side along an edge of the panel for transferring a fluid such as a liquid or a gas between a fluid supply on the protected side and a fluid outlet on the threat side. The cable and/or conduit, respectively, may be at least partly accommodated in the edging and/or in one of the connectors.

A connector or a group of connectors may define a recess in a direction parallel to the first and/or second face forming a partly enclosed channel extending from the protected side to the threat side for accommodating an object in the channel and sideways receiving the object into the channel. The object may in particular be a cable or conduit.

Either or both such embodiments may protect the object, cable and/or conduit, respectively, and reduce or prevent it from getting caught behind another object, which may cause damage and/or may even cause a danger to a user of a shield comprising the shield body.

Note that a cable and/or conduit may be provided as (part of) an accessory in a shield system comprising a shield body as described herein. Such accessory cable and/or -conduit may then be suitably connected with at least part of a cable and/or conduit comprised in the shield body, if provided.

The edging may comprise an overmoulded portion, wherein the connectors may be at least partly accommodated in and fixed by the overmoulded portion of the edging, and/or wherein, if present, the cable and/or the conduit, respectively, may be at least partly accommodated in and fixed by the overmoulded portion of the edging. Overmoulding provides a close adherence of the overmoulding material to the shield panel and the connector and it may provide fixation of these parts to each other, providing robustness.

The adherence to at least part of the shield panel and the connector may be mechanical and/or chemical in nature.

In view of the above, in an aspect a shield system is provided comprising the shield body as disclosed herein and one or more accessories to the shield body comprising mating counterconnectors for mounting, in particular removably mounting, the one or more accessories to the shield body.

In the shield system, the one or more accessories may comprise an expansion bracket for supporting one or more further accessories, wherein the expansion bracket comprises one or more mounting connectors for mounting, in particular removably mounting, the one or more further accessories to the expansion bracket using mating mounting counterconnectors. The expansion bracket may be configured to extend across the shield body and to be mounted both to at least one of the connectors located at or near one panel edge and at least one of the connectors located at or near an opposite panel edge. Thus, the mounting may traverse the shield body, facilitating mounting further accessories onto the shield body on a desired location.

The expansion bracket may comprise at least one cable portion for transferring power and/or a signal such as a sensor signal between the protected side and the threat side and/or at least one conduit portion for transferring a substance such as a liquid or a gas between a substance supply on the protected side and a substance outlet on the threat side.

The one or more accessories and/or further accessories may comprise at least one of: a light source; a loudspeaker; a visual indicator, such as indicia, light banner, display, etc.; a sensor, such as a camera (e.g. visible and/or infrared-sensitive), a microphone, a substance detector like a gas detector; a recording device for one or more sensor signals and/or written information; a projectile projector, such as a gun, a taser, etc.; an electric shocking device; a substance projector like a gas projector, a liquid projector, a spray projector, a flame thrower; and optionally an associated substance supply; a sharp weapons device, e.g. a pointed tip and/or a blade; a power source such as a battery, possibly rechargeable; an ammunition holder; a baton holder; a handcuff holder; a supplementary ballistic panel holder; a carrying support such as a handle, a cuff, a sling; a wheel, a set of wheels.

At least one accessory may be mounted to extend over the edging from the threat side to the protected side; such accessory may in particular accommodate or comprise a cable and/or conduit.

The shield system allows providing a robust shield in diverse configurations. Configurations may be variable, e.g. providing more or fewer accessories without affecting shield integrity.

In view of the above, in an aspect is provided a method of manufacturing a shield body as disclosed herein, comprising:

providing a shield panel having a first and second face for defining a threat side in a threat direction and a protected side in a protected direction opposite the threat side and threat direction, respectively, and having opposite lateral panel edges;

providing connectors for removably mounting one or more accessories to the shield body on the threat side, in particular using mating counterconnectors;

providing an edging to the panel covering at least part of the panel edges such that at least some of the connectors are arranged on one common side and/or at least one of exposed and exposable on the one common side of the shield panel, and at least partly accommodated in the edging.

At least some of the connectors are arranged on, preferably fixed such as clamped onto the panel, and, possibly except for a hole for a window, the panel may be devoid of holes into and/or through the panel, in particular holes associated with a connector and/or attachment of a connector. The method further comprises providing an edging to the panel comprising accommodating and covering at least part of the thus-attached connectors to the panel.

Providing an edging to the panel covering at least part of the panel edges may comprise overmoulding at least part of the panel edges and at least part of the connectors.

BRIEF DESCRIPTION OF THE DRAWINGS

The above-described aspects will hereafter be more explained with further details and benefits with reference to the drawings showing a number of embodiments by way of example.

DETAILED DESCRIPTION OF EMBODIMENTS

Figure 1C:
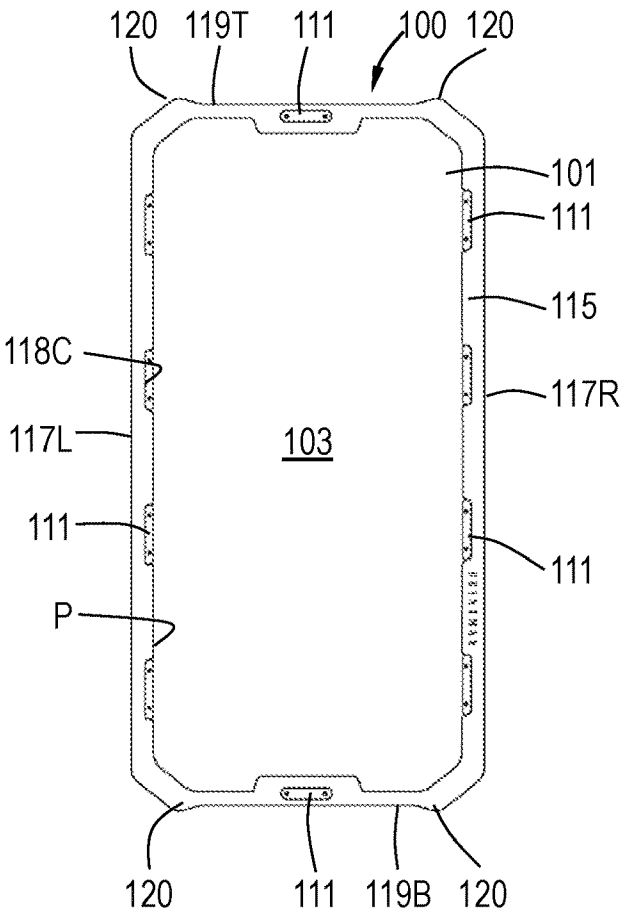
FIGS. 1A-1C, 2A-2C, 3A-3C, and 4A-4C, respectively, show method steps of manufacturing embodiments of a shield body.

It is noted that the drawings are schematic, not necessarily to scale and that details that are not required for understanding the present invention may have been omitted. The terms "upward", "downward", "below", "above", and the like relate to the embodiments as oriented in the drawings, unless otherwise specified. Further, elements that are at least substantially identical or that perform an at least substantially identical function are denoted by the same numeral, raised by hundreds, and/or individualised with alphabetic suffixes.

Further, unless otherwise specified, terms like "detachable" and "removably connected" are intended to mean that respective parts may be disconnected essentially without damage or destruction of either part, e.g. excluding structures in which the parts are integral (e.g. welded or moulded as one piece), but including structures in which parts are attached by or as mated connectors, fasteners, releasable self-fastening features, etc. The verb "to facilitate" is intended to mean "to make easier and/or less complicated", rather than "to enable".

Figure 1B:
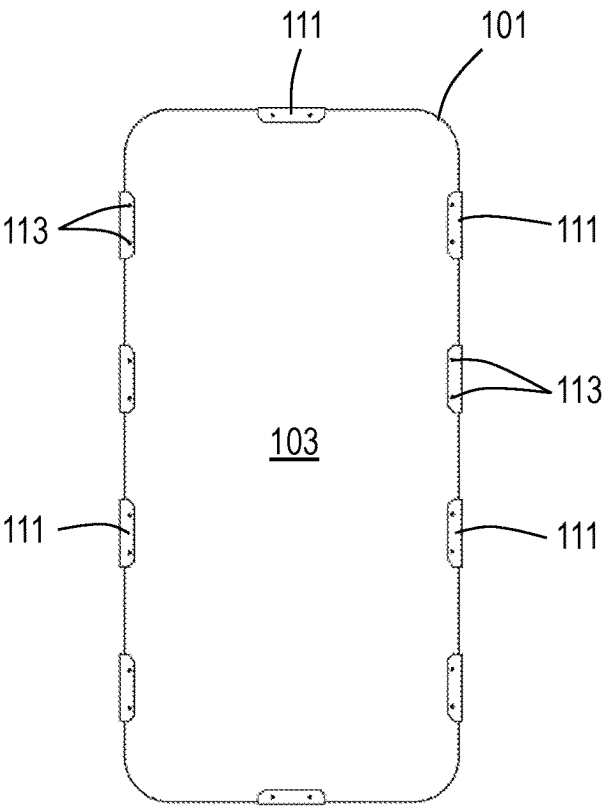
Figure 1A:
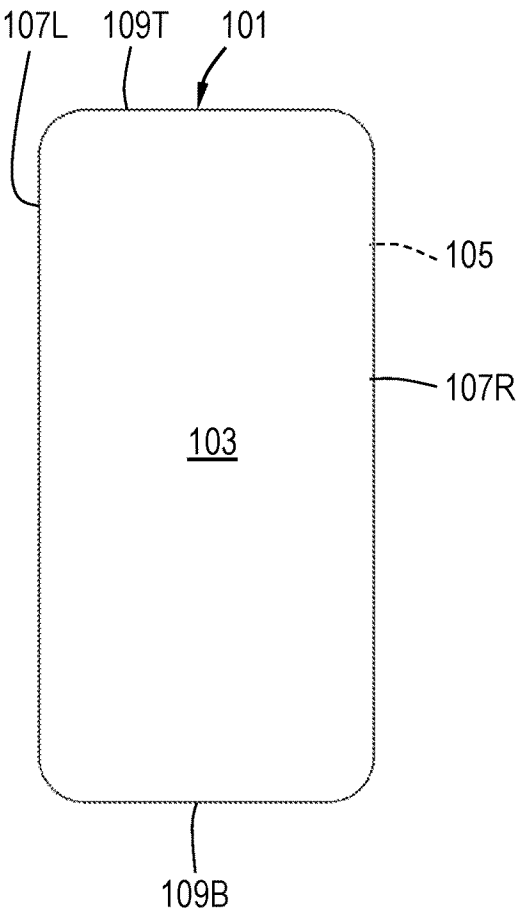

FIG. 1A-1C shows a method of manufacturing a ballistic shield body 100 (FIG. 1C).

FIG. 1A shows providing a ballistic shield panel 101 having a first face 103 and an opposite second face 105 (not visible). The first face 103 may define a threat side in a threat direction and the second face 105 may define a protected side in a protected direction opposite the threat side and threat direction, respectively, at least when the panel 101 is comprised in a shield (see below). The shown panel 101 has a largely rectangular outer shape providing opposite lateral panel edges 107L, 107R, and top and bottom edges 109T, 109B pairwise opposite each other.

In some embodiments the shield panel may have a different edge shape, e.g. round, hexagonal, octagonal, provided with lateral recess and/or with a relatively broad portion and a relatively narrow portion, serrated.

FIG. 1B shows that the shield panel 101 has been provided with a plurality of connectors 111. The connectors 111 are configured for mounting one or more accessories to the shield body 100 on the threat side. Accessories can be mounted to the connectors 111 using mating counterconnectors. As an example, each connector 111 comprises two screw threaded holes 113, but more or less may be provided. Some, preferably all, connectors 111 may be substantially identical, as shown, but mutually different connectors may be provided. The connectors 111 may be at least partly of a metal, e.g. aluminium, steel or titanium.

The connectors 111 are arranged along the edges of the shield panel 101 and may be attached to the shield panel. Here, the connectors 111 are arranged substantially equidistant along each edge 107. In another embodiment (not shown) plural connectors 111 may be arranged along one or more edges in groups of connectors 111 separated by relatively small distances, the groups of connectors 111 being separated by relatively large distances.

FIG. 1C shows that the shield panel 101 provided with the connectors 111 of FIG. 1B has further been provided with an edging 115 accommodating the connectors 111, thus forming the desired shield body 100 having opposite lateral shield body edges 117L, 117R, and top and bottom shield body edges 119T, 119B opposite each other. The connectors 111 are arranged on the first face 103 to be exposed on the threat side. The connectors 111 being accommodated in the edging 115 assists protecting the connectors 111, and at least part of accessories and/or counterconnectors mounted to the connectors 111 from external forces. The edging 115 provides robustness to the panel 101 and to the connectors 111. The edging 115 may in particular have been formed by overmoulding, providing the shield body as an integral whole. Overmoulding may also fix, or fix more strongly, the connectors 111 to the panel 101.

The edging 115 may define a shape of the shield body; e.g. FIG. 1C shows that the perimeter shape of the shield body 100 comprises optional protrusions 120 absent from the shape of the shape of the panel 101 (FIGS. 1A, 1B). Such protrusions 120 may provide standing points and/or provide protection for portions between the protrusions, e.g. an accessory mounted to the shield body. In some cases, at least part of a particular shape of the edging 115 may just serve for a desired appearance.

FIGS. 1B-1C show that along the lateral shield body edges 117L, 117R the respective connectors 111 are only partly surrounded by the edging 115, the edging 115 defining a general perimeter P that provides recesses 118C open towards a centre of the shield body 101. Along the top and bottom shield body edges 119T, 119B, the respective connectors 111 are surrounded by the edging 115. In some embodiments, removable insert portions may be provided to selectively cover and expose one or more connectors 111 and/or at least partly fill recesses in the edging 115.

Figure 2C:
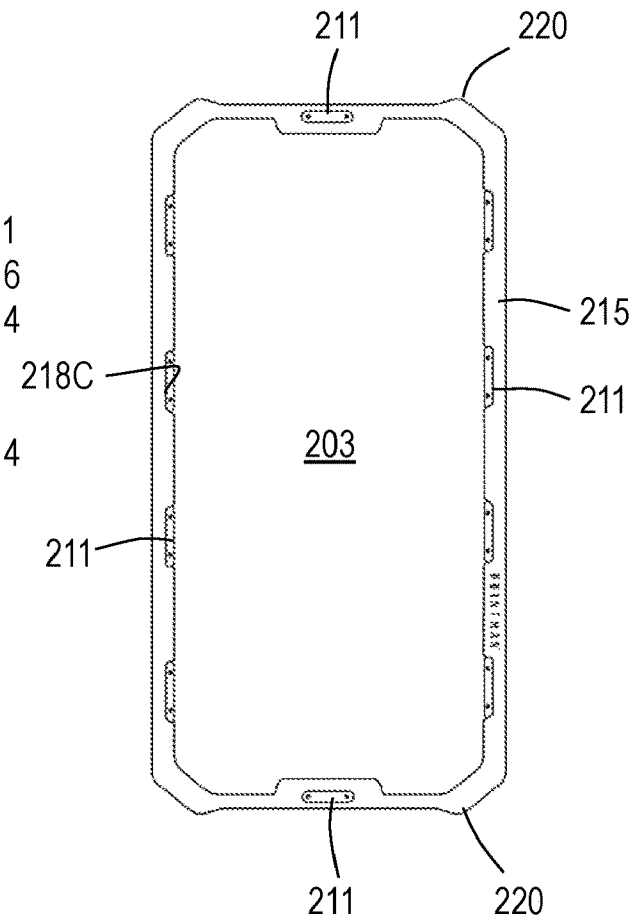
Figure 2B:
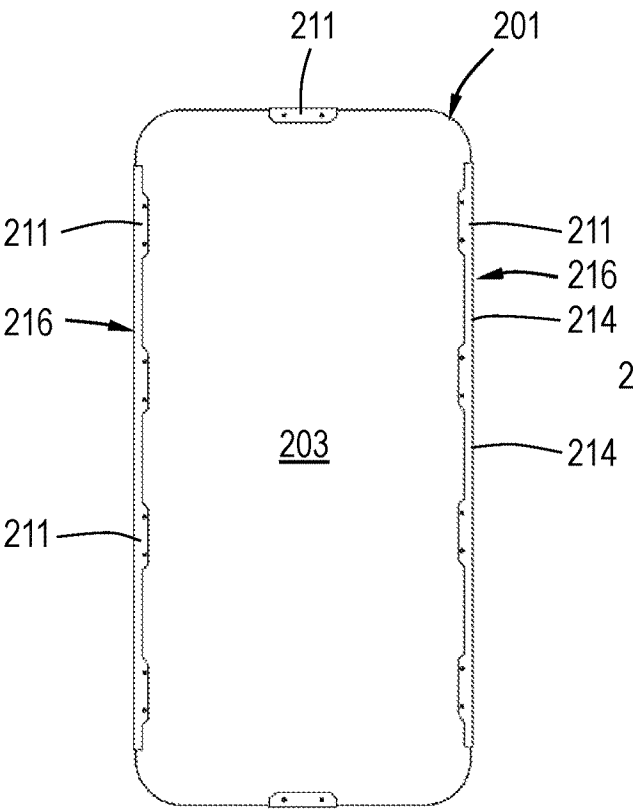
Figure 2A:
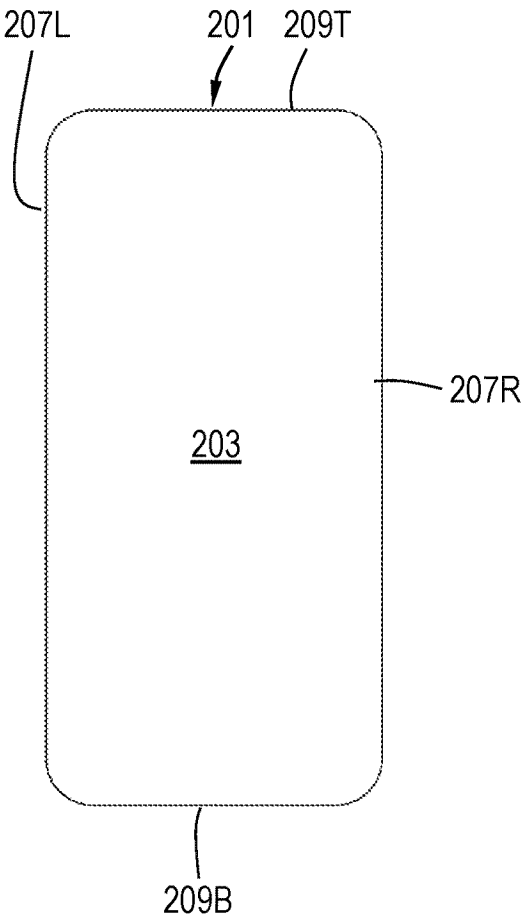

FIGS. 2A-2C show, like FIGS. 1A-1C, (manufacturing steps of) a shield body 200. In this embodiment, plural connectors 211 may be identified connected to each other by a backing 214 along the lateral edges 207L, 207R. Here, plural connectors 211 and the backing 214 are formed as an integral whole in a profiled rail 216, provided along the lateral edges 207L, 207R of the shield panel 201. Such rail may provide fortification to the connectors 211 and/or to the shield panel edges 207L, 207R. However, after providing the edging 215 the shield bodies 100 (FIG. 1C) and 200 (FIG. 2C) may look substantially equal as shown.

In other embodiments, plural integrated objects and/or rail portions each connecting or comprising plural (groups of) connectors may be provided and/or different arrangements along different edges may be provided.

Figures 3A, 3B, 3C:
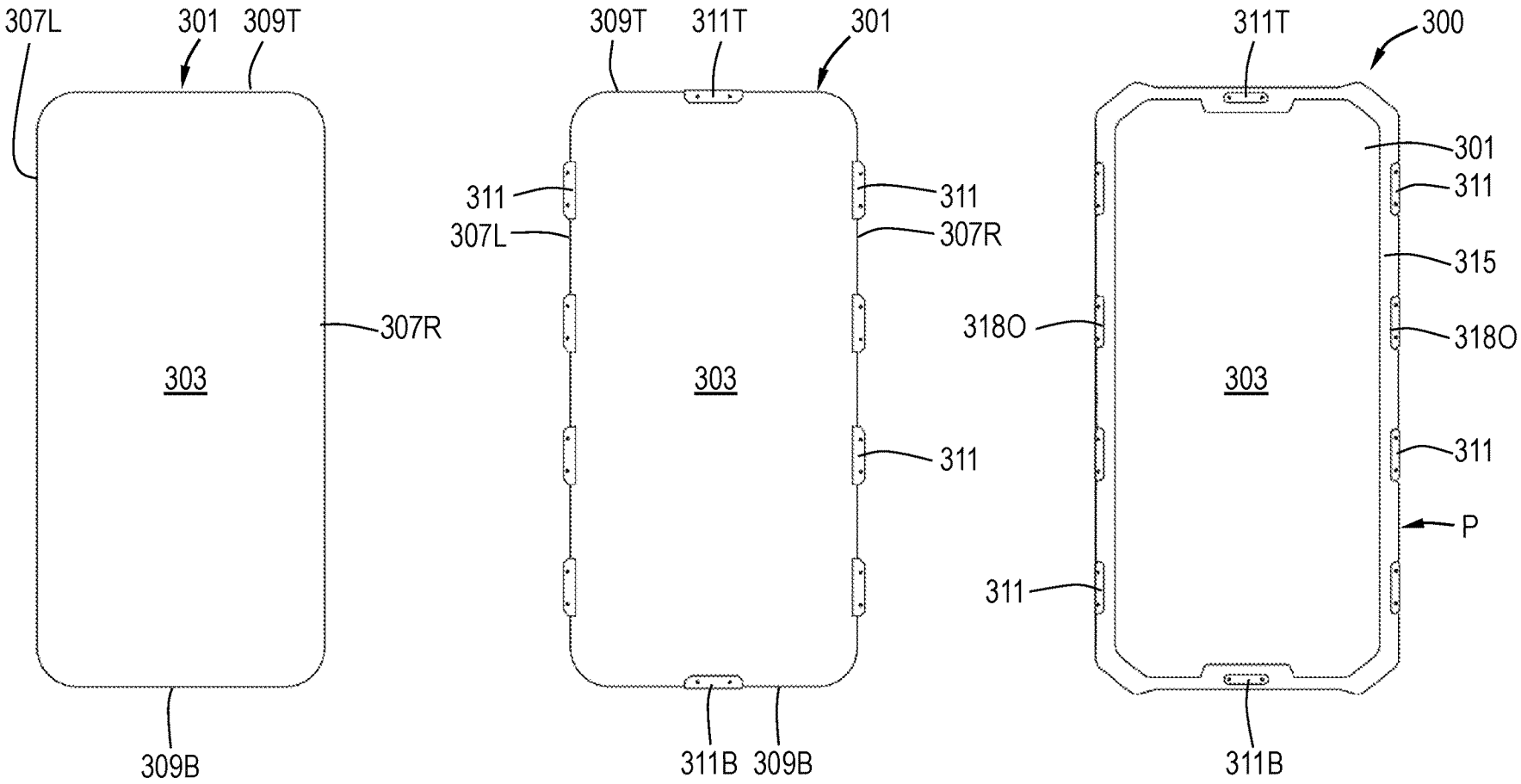

FIGS. 3A-3C show (manufacturing steps of) a shield body 300, like FIGS. 1A-1C. A difference is that here a plurality of connectors 311 are arranged outside the perimeter of the shield panel 301. As an option, only the connectors 311 along the lateral edges 307L, 307R of the panel 301, are formed in such manner whereas connectors 311T and 311B along top and bottom edges 309T, 309B, respectively, are formed differently, e.g. formed as in FIGS. 1A-1C; 2A-2C. The edging 315 is, accordingly, formed different from FIGS. 1A-1C; 2A-2C and defines a perimeter P that provides recesses 3180 that open outward from the shield body 301 along the shield body edges 317L, 317R exposing the connectors 311 towards at least one direction e.g. the threat direction, preferably towards both opposite directions, the threat direction and the protected direction.

Figure 4C:
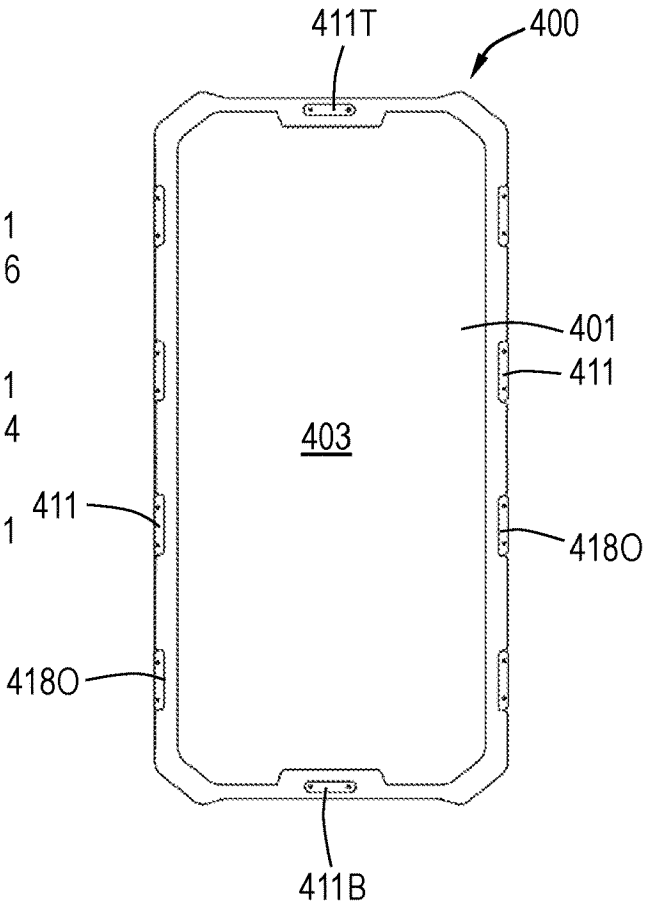
Figure 4B:
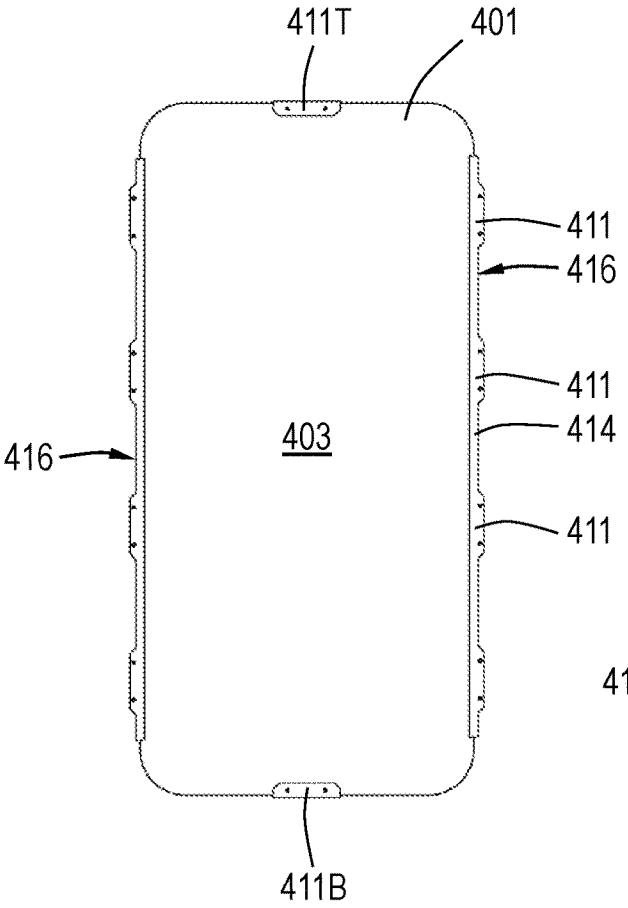
Figure 4A:
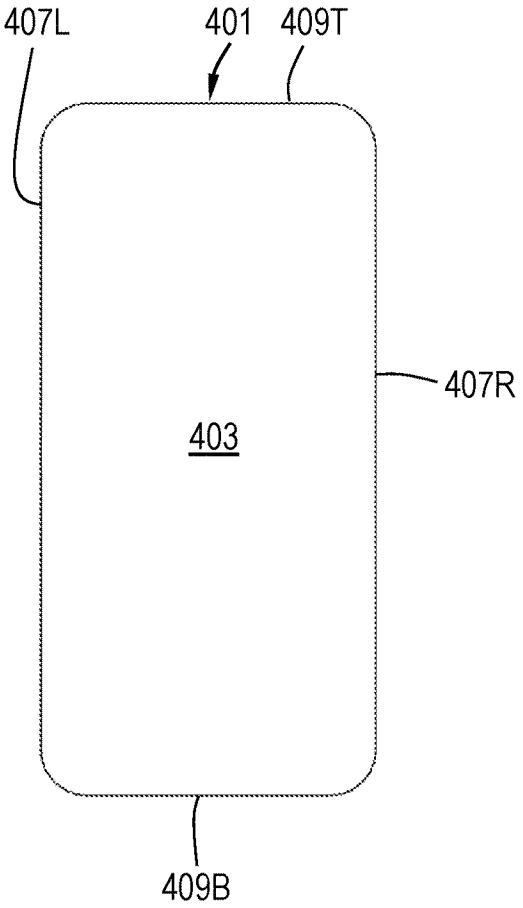

FIGS. 4A-4B show (manufacturing steps of) a shield body 400, like FIGS. 2A-2C wherein the connectors 411 along the lateral edges 407L, 407R of the panel 401 are formed like the connectors 311 in FIGS. 3B-3C but, like in FIGS. 2B-2C, connected to each other by a backing 414 along the lateral edges 407L, 407R here amounting to being formed as an integral whole in the form of a profiled rail 416 provided along the lateral edges 407L, 407R of the shield panel 401. Similarly to shield bodies 100 and 200, after providing the edging 415 forming recesses 4180, the shield bodies 300 (FIG. 3C) and 400 (FIG. 4C) may look substantially equal as shown.

Figure 5A:
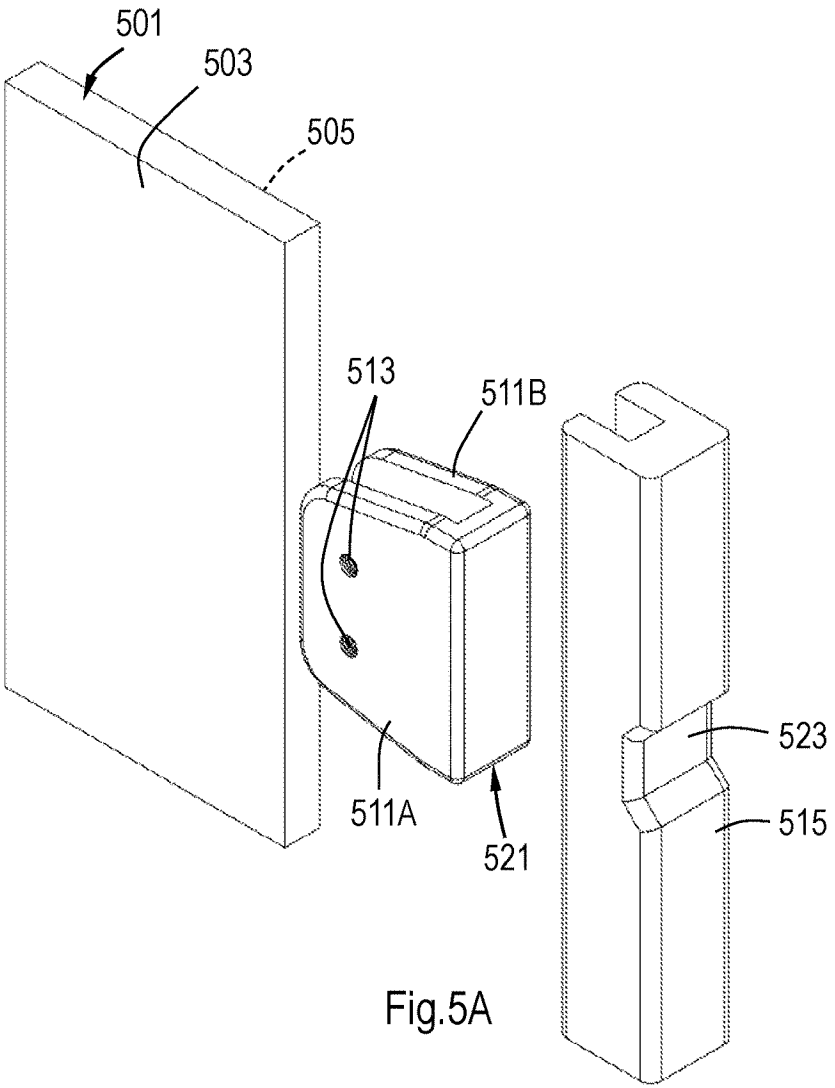
FIGS. 5A-5C; 6A-6C, respectively, show (attachment of) a connector onto a shield panel to form a shield body.
Figure 5B:
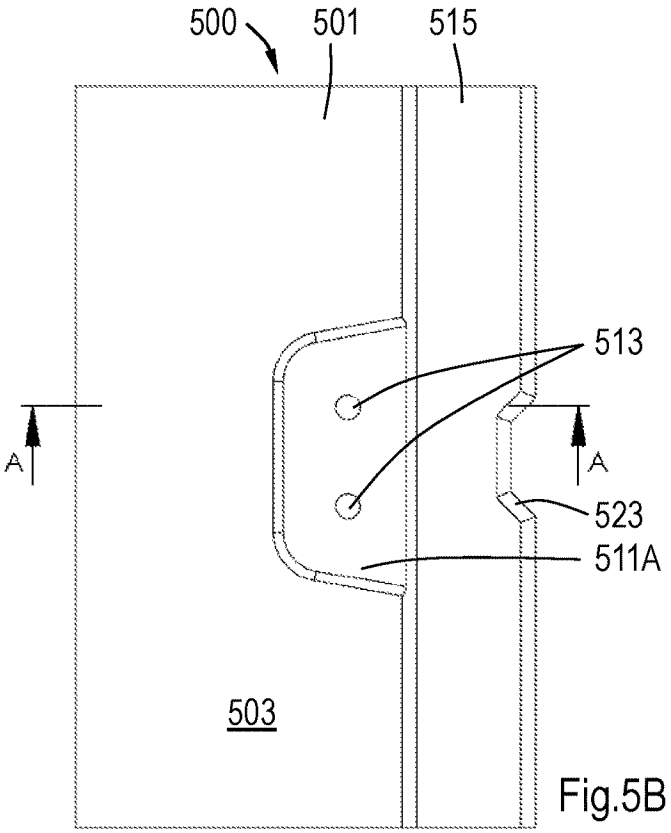
Figure 5C:
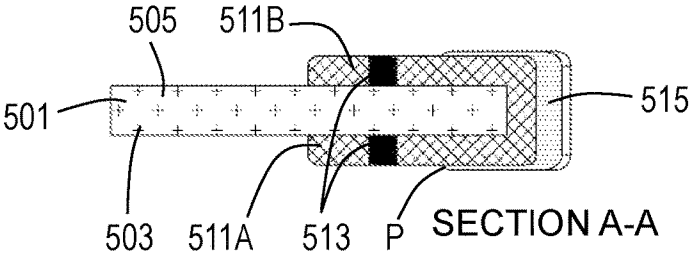

FIGS. 5A-5C show (attachment of) a connector 511, providing a first connector 511A and a second connector 511B, onto a shield panel 501 to form a shield body 500. The connector 511A comprises, as before, two screw threaded holes 513 as an option, and is integrated into a generally U-shaped connector mounting bracket 521. The mounting bracket 521 allows clamping the connector 511A onto the shield panel 501 without substantially deforming or damaging the panel 501. The mounting bracket 521 may provide a connector 511B opposite the connector 511A, which may be substantially equal to the connector 511A, as here, or different from that.

After attaching the mounting bracket 521 to the panel, an edging 515 is provided covering part of the shield faces 503, 505 and at least partly the connectors 511A, 511B to form the desired shield body 500. The edging 515 may comprise or be (synthetic) rubber or (of) another material and it may clamp onto the panel 501. The edging 515 may comprise one or more recesses 523 for at least partly receiving and possibly protecting an object therein.

FIGS. 5B-5C show that the connectors 511A, 511B are partly accommodated in the edging 515 and protrude from a perimeter P of it towards a centre of the shield panel 501.

FIG. 5C shows that the holes 513 of the connectors 511A, 511B are through holes and that, however, the shield panel 501 is intact between the holes and devoid of holes itself, at least at and near the connectors. At least one of the holes 513 may be a blind hole to further protect the panel 501.

Figure 6A:
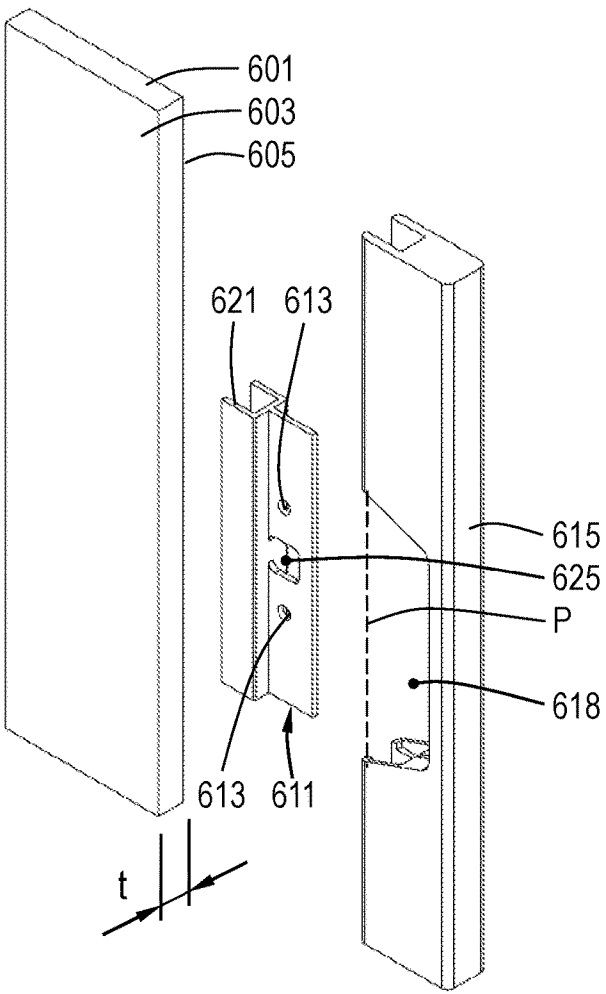
Figure 6B:
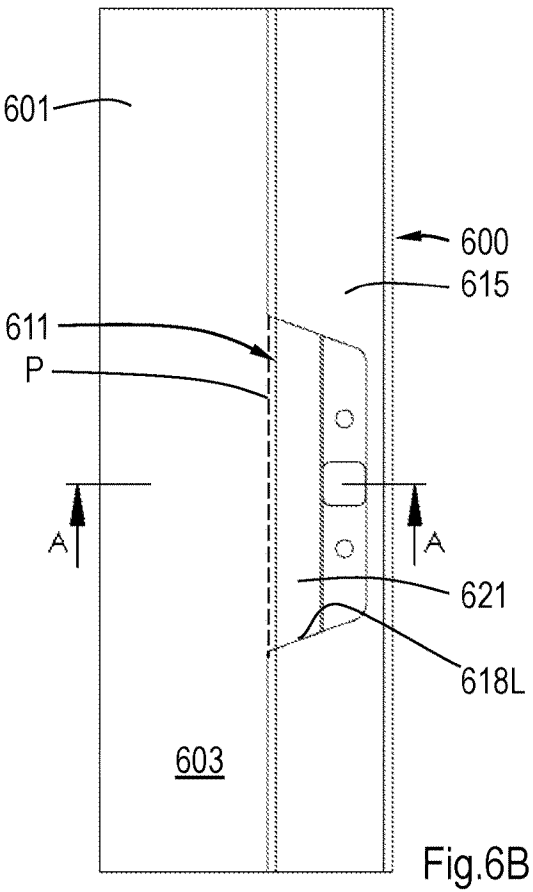
Figure 6C:
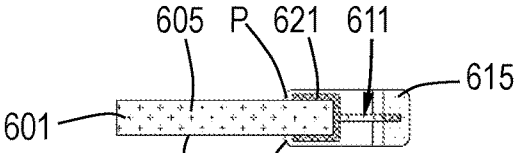

FIGS. 6A-6C show (attachment of) a connector 611 onto a shield panel 601 to form a shield body 600. The connector 611 comprises plural holes 613 and 625, and a mounting bracket 621 which fits around an edge of the panel 601 for attaching, and possibly fixing, the connector 611 to the panel 601, such that the connector extends adjacent and outward from the panel 601, preferably substantially symmetric with respect to a thickness t of the panel 601 at the edge at the location of the connector 611. An edging 615 comprising a recess 618C is formed to accommodate the connector 611 and cover it on an outward side of the shield body 600.

One or more of the holes 613 may be provided with a screw thread and/or some of the holes 613, 625 may have different sizes and/or shapes as shown here. E.g., the hole 625 may serve for accommodating a cable or a tube from one side of the shield body to the other side thereof.

FIGS. 6A-6C show that the connector 611 provides through holes 625 through the shield body 600 but passing outside of the shield panel 601. Thus, the connector 611 leaves the ballistic properties of the panel 601 intact.

Figure 7A:
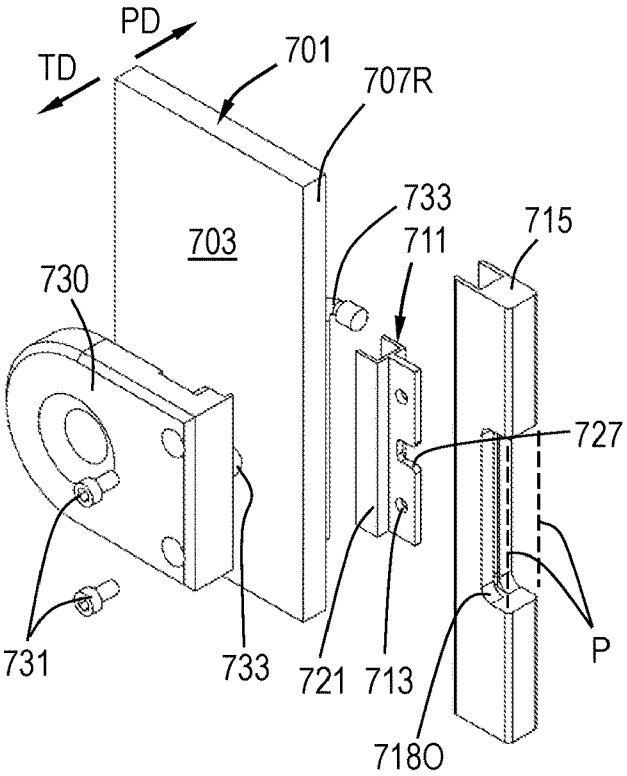
FIG. 7A is an exploded drawing of part of a shield body.
Figure 7D:
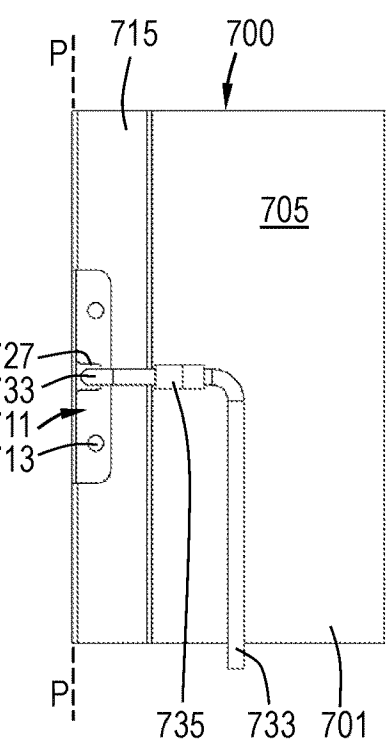
FIGS. 7B-7D and 7E are front, side, back and cross section views, respectively, of the shield body part, as indicated.
Figure 7C:
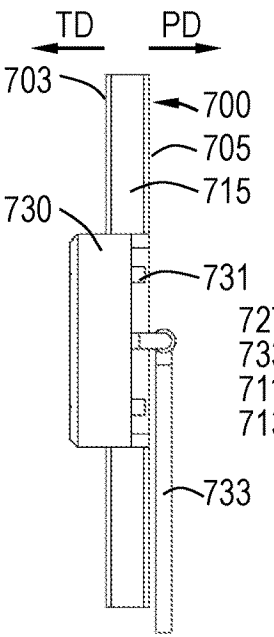
Figure 7B:
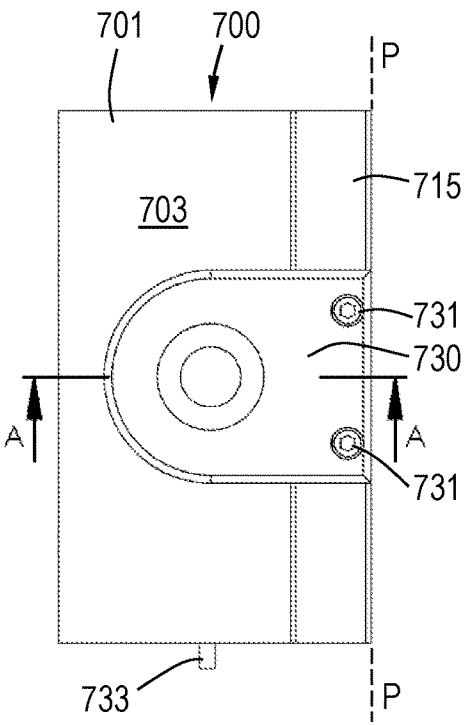
Figure 7E:
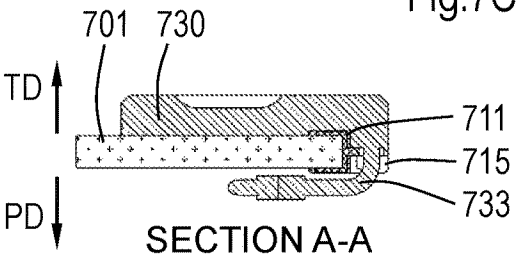

FIG. 7A is an exploded drawing of part of a shield body 700 comprising a shield panel 701, a connector 711 and an edging 715, to which a lamp 730 as an exemplary accessory is mounted. FIGS. 7B-7D and 7E are front, side, back and cross section views, respectively, as indicated.

Somewhat comparable to the connector 611, the connector 711 comprises plural holes 713 and a cavity 727 for a cable formed by a recess in a direction parallel to the faces of the panel 701 forming a partly enclosed channel extending from the protected side to the threat side for accommodating an object in the channel and sideways receiving the object into the channel. The edging 715 comprises a recess 7180 exposing the connector 711 towards both the threat direction TD (front direction) and protected direction PD (back direction).

The lamp 730 is mounted on the threat side of the shield body 700. The lamp 730 is mounted to the connector 711 with screw bolts 731 mated to the holes 713. In an embodiment, the holes 713 could be through holes and the bolts be fixed with nuts. Due to the connector 711, the accessory and its mounting portions, e.g. here the bolts 731 and holes accommodating the bolts 731, need not be particularly robust and/or bullet-proof.

The lamp 730 is connected with a power cable 733 to a battery mounted to the shield body 700 on the protected side (not shown). The power cable 733 is received in the recess 727. The power cable 733 could comprise connectors 735 and may be attached to the shield body using a hook-and-loop type fastener (e.g. Velcro®) or tie rips or any other suitable means.

The lamp 730 or other accessory may be formed, as shown, to conform to the shape of the shield panel 701 and the edging 715, e.g. reducing volume. E.g. at least part of the lamp 730 may closely fit the recess 7180, providing extra mechanical stability and/or providing a substantially closed perimeter P to the shield body 700.

Figure 8A:
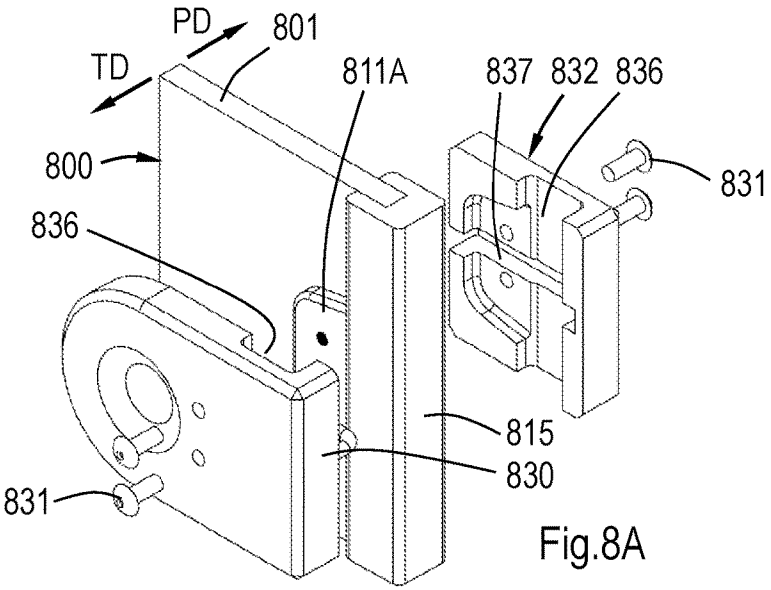
FIGS. 8A and 8B are exploded drawings in front and rear view of part of a shield body.
Figure 8B:
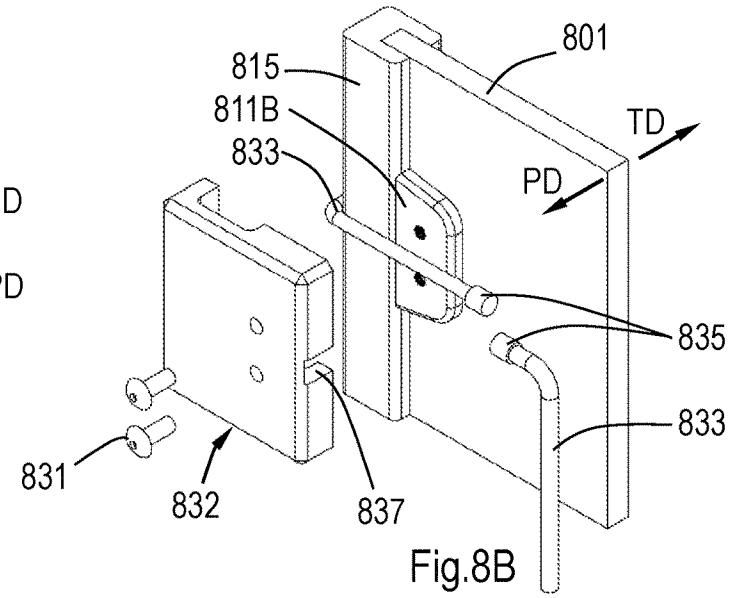
Figure 8D:
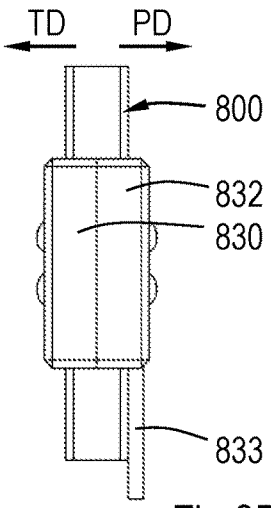
FIGS. 8C-8E and 8F are front, side, back and cross section views, respectively, of the shield body part as indicated.
Figure 8F:
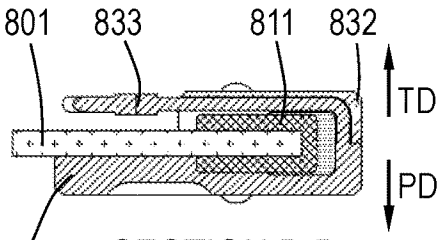
Figure 8C:
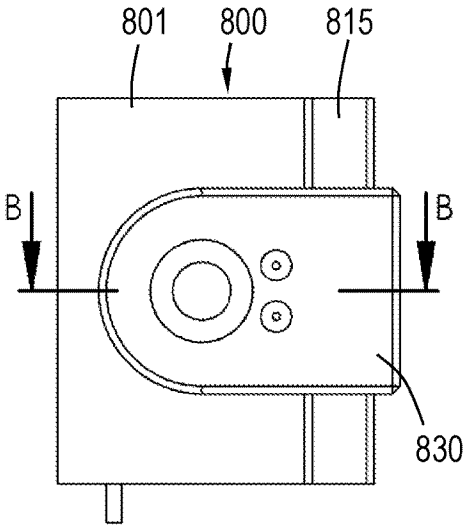
Figure 8E:
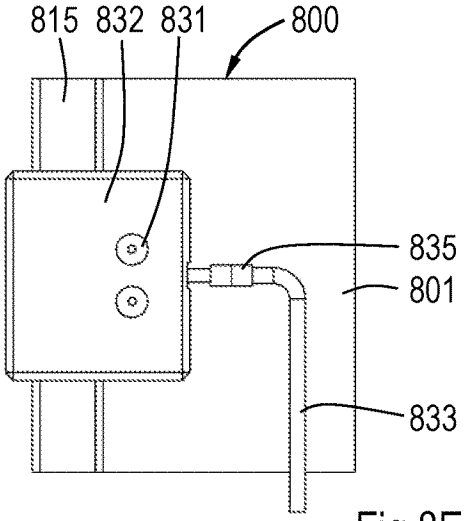

FIGS. 8A and 8B are exploded drawings in front and rear view of part of a shield body 800 comprising a shield panel 801, a connector 811 and an edging 815, to which an accessory 830 is mounted. FIGS. 8C-8E and 8F are front, side, back and cross section views, respectively, as indicated. The shield body 800 and connectors 811 closely resemble those of the shield body 500 of FIGS. 5A-5C. Here, the connectors 811 protrude towards a shield body centre from the edging 815 which shows no recess.

The accessory 830 is mounted on one side to (screw holes 813 of) the connector 811A using bolts 831 mated to the screw holes 813. The accessory 830 in this case extends outward from the edging 815 and grips at least partly around the edging 815. On the opposite side, an optional complementary accessory portion 832, e.g. a cable cover as here, is mounted to the connector 811B using bolts 831 mated to screw holes of that connector 811B. The accessory 830 and the complimentary accessory portion 832 may, thus mounted, form a substantially continuous object, preventing risks of snagging the cable 833. Note that a similar substantially continuous object may be suitably mounted to any other (connector of a) shield body disclosed herein. At least part of an accessory may be formed complementary to at least part of the shield body; a close fit may increase stability of the assembly of shield body and accessory. E.g. a recess 836 in the accessory 830 and/or the complimentary accessory portion 832, as shown, may accommodate part of the edging 815 and/or a connector 811 and increase mechanical stability Both the accessory 830 and the complimentary accessory portion 832 comprise an optional channel portion 837 defining a channel for guiding a cable 833 (here provided with a connector pair 834 to another cable section 835) or conduit between the accessory on the one side of the shield body 801 and the other side thereof, such that the cable or conduit remains substantially covered and unexposed.

Figure 9:
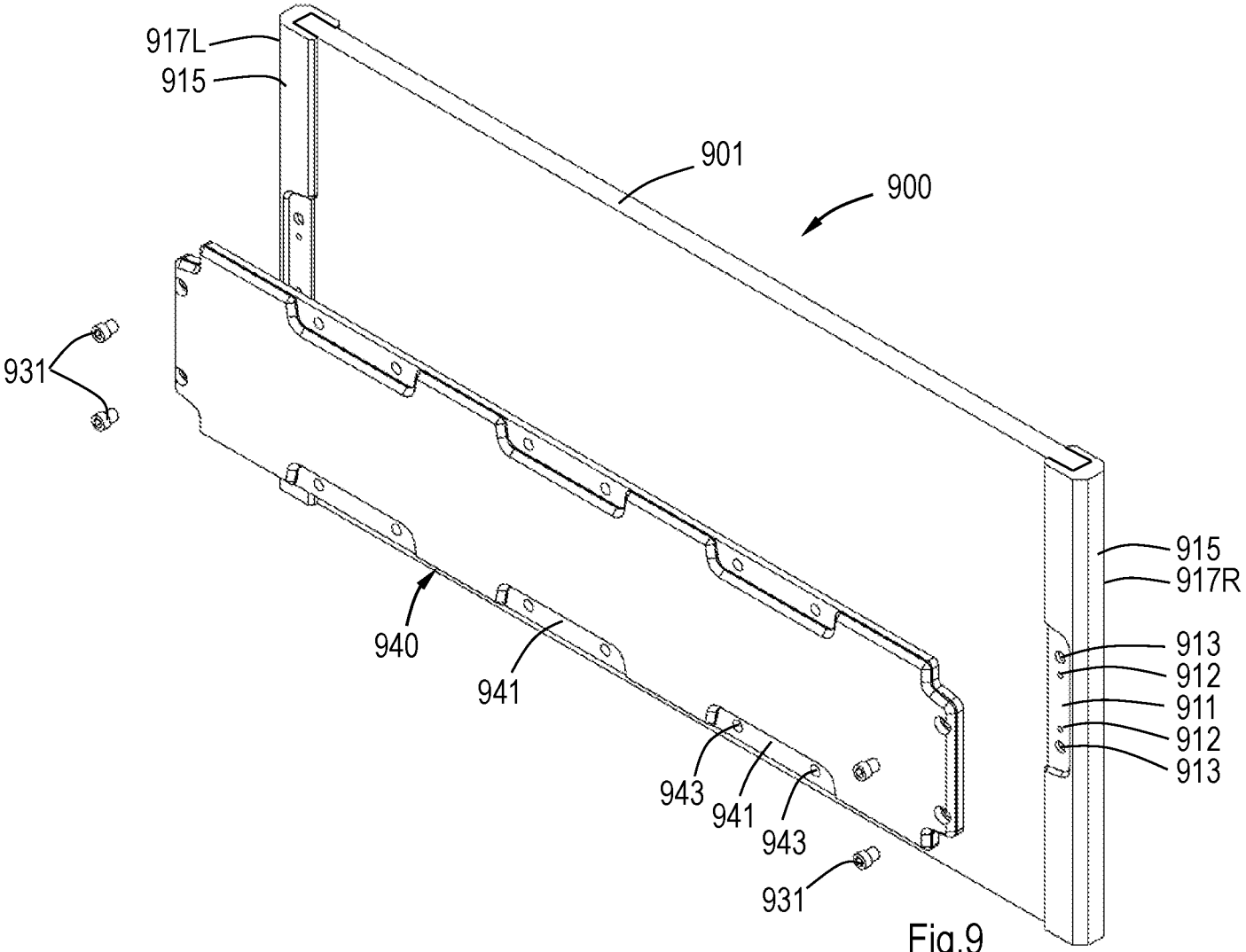
FIG. 9 shows part of a shield body and an expansion bracket for and supporting one or more further accessories.

FIG. 9 shows part of a shield body 900 and an expansion bracket 940 for mounting and supporting one or more further accessories on the shield body 900.

The shown shield body 900 is comparable to the shield body 100 and/or 200 of FIG. 1C. Here, however the connectors 911 are provided with additional connection and alignment portions 912 next to screw holes 913.

The expansion bracket 940 is mounted with fasteners 931 serving as counterconnectors to the connectors 911. The expansion bracket 940 itself comprises mounting connectors 941 for removably mounting one or more further accessories to the shield body 900 and/or defining a mounting position for an accessory away from connectors 911 arranged at or near the shield body edge 917R, 917L, e.g. more central to the shield body 900. The connectors 941 of the expansion bracket 940 may comprise threaded holes 943. The connectors 941 of the expansion bracket 940 may be identical to or different from at least some of the connectors 911 of the shield body 900. The expansion bracket 940 may be from the same or a different material or material combination as the shield panel, connectors and/or edging of the shield body 900. As an option, the expansion bracket 940 may comprise a layered structure as indicated and/or have shape and/or profile similar to that of the shield body 900 to which the expansion bracket 940 is (to be) mounted. The shown expansion bracket 940 may be mounted to the shield body 900 traversing the shield body 900 from one of the connectors 911 to another one of the connectors 911 on laterally opposite panel edges 917L, 917R. Note that an expansion bracket need not fully traverse the shield body and at least part of an expansion bracket may be formed differently, e.g. being T- or +-shaped.

Figure 10B:
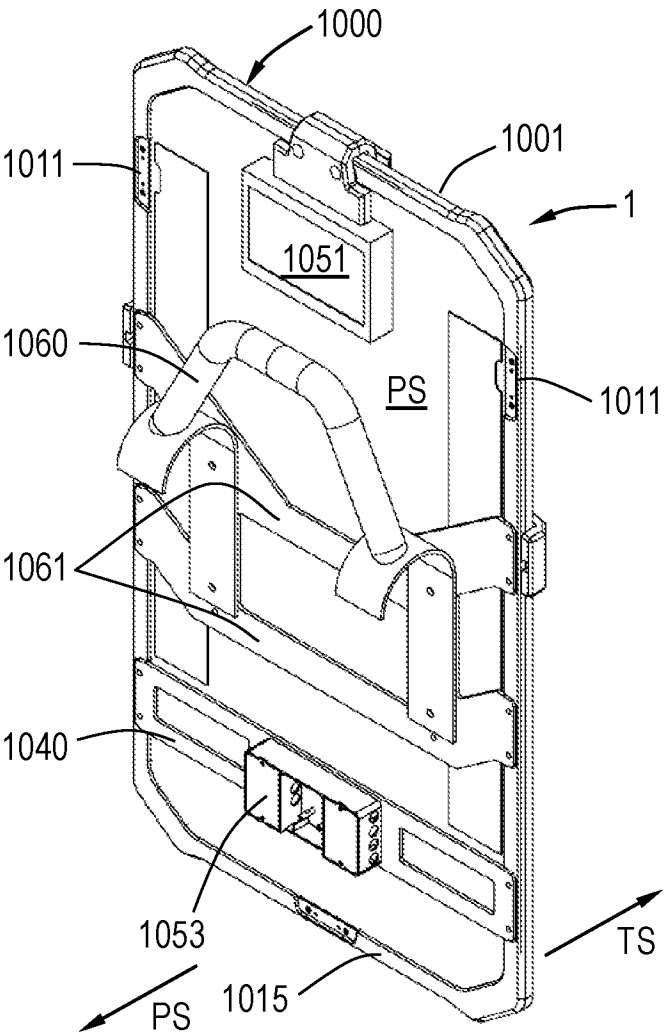
FIGS. 10A-10B and 11A-11B show two sides of a shield of a shield system as provided herein, in perspective and exploded views, respectively
Figure 10A:
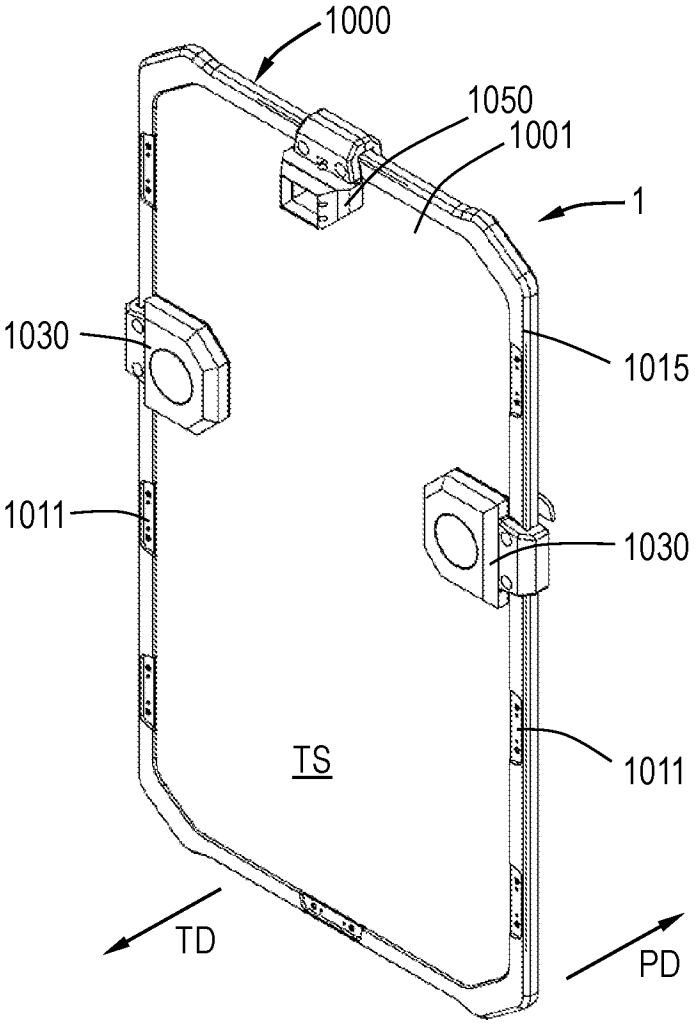
Figure 11B:
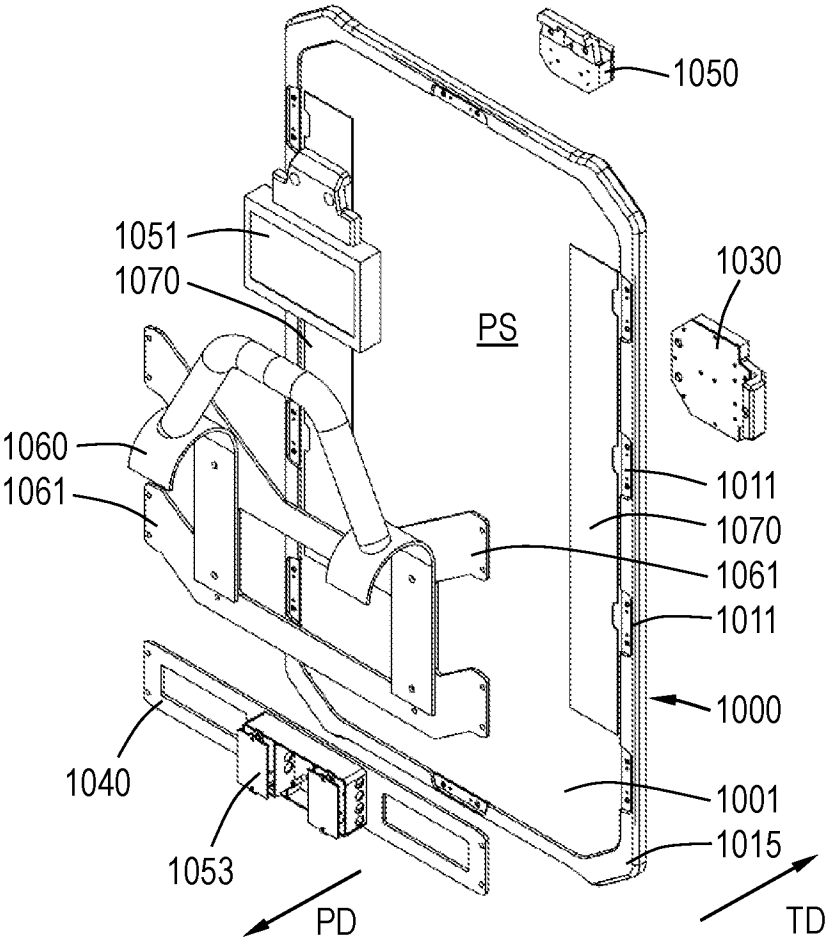
Figure 11A:
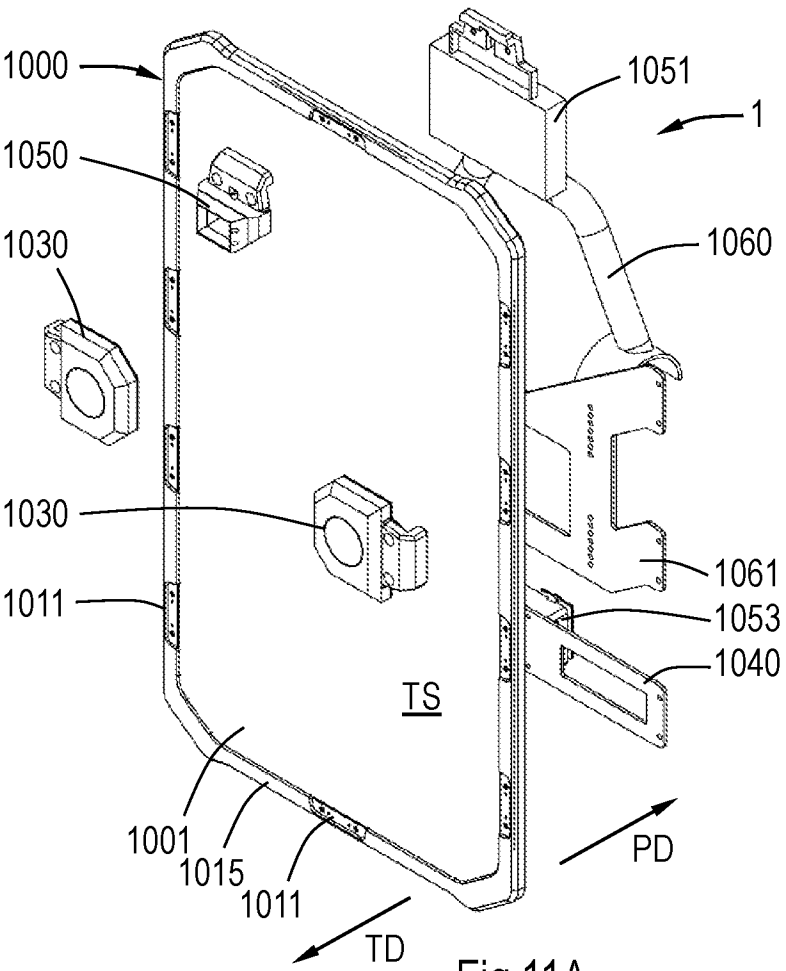

FIGS. 10A-10B are front and back views of a shield 1 of a shield system as provided herein; FIGS. 11A-11B are corresponding exploded views. The shield 1 comprises a shield body 1000 comprising a shield panel 1001, connectors 1011 and an edging 1015. The shield has a protected side PS, opposite the threat side TS. Note that the shield body 1001 could be concave, in particular curved around the protected side. To some of the connectors 1011 on the threat side TS, lights 1030 and a camera 1050 are mounted. An expansion bracket could be mounted as well (not shown). To the connectors 1011 on the protected side a screen 1051 or other camera display and a battery 1053 are mounted. Here, the battery 1053 is mounted to an expansion bracket 1040 of other design than before. On the protected side, cables are routed from the battery 1053 to the lights 1030 and the camera 1050, the cables optionally being covered by protective covering like sticky and/or hook-and-loop-fastened strips 1070 and/or accommodated in the connectors 1011.

Also, to connectors 1011 on the protected side PS a carrying support 1060 is mounted for carrying the shield 1000. The carrying support 1060 is mounted to one or more optional adjustment plates 1061 mounted to plural connectors 1011; e.g. four as shown. This may distribute forces over the shield body 1000 better than mounting to fewer connectors 1011. The robustness and balance of the shield 1 may in particular be better than when the carrying support 1060 were mounted to the shield using bulletproof bolts penetrating the shield panel 1001, e.g. since the shield panel 1001 may remain intact, the connections may be significantly lighter-weight than bulletproof bolts and structures accommodating and/or supporting them. Also, plural and widespread mounting portions (1061 to 1011) reduce chances that the carrying support 1060 gets damaged inoperably, and a carrying support 1060 may be exchanged more easily. At or near the carrying support 1060 controls for accessories may be provided, e.g. power buttons (not shown) for operating lamps, a loudspeaker and/or a camera.

The carrying support a may be shaped and/or sized differently, e.g. according to one or more of size, weight, use conditions, control options, user preference, etc. E.g. for one-handed carrying, two-handed carrying, sling-support and/or user preference etc. The shield may be sized for full body protection of a standing individual, or for torso protection. In some embodiments one or more shields may be shaped rectangular wherein a ratio of the long sides to short sides is 2:1, e.g. being sized like standard DIN paper sizes A0, A1, A2, A3, or A4. Such ratio may simplify scaling protective surface area by combining shields of different sizes. Conformance to DIN A-series sizes may facilitate carrying a shield in a briefcase.

A connector may comprise, or be formed as, a tubular portion accommodated in the edging, possibly provided as an insert into the edging having one or more external flange portions and/or external screw thread portions that may at least partly be accommodated in the edging. Also or alternatively a threaded portion providing a threaded hole may be formed in the edging, e.g. comprising or being formed as such tubular portion being at least partly internally threaded and/or comprising, or being formed as, a coiled wire helical screw thread insert (e.g. of a type known as "helicoil"). Such tubular and/or coiled wire insert may or may not be attached to the panel.

E.g., FIGS. 12-15B show providing a ballistic shield panel 1101 having a lateral panel edge 1107 with a plurality of connectors 1111A, 1111B, 1171. The connectors 1111A are formed as tubular portions having internally threaded through holes 1113A.

The connectors 1111B are formed as tubular portions having internally threaded through holes 1113B connected to each other by a backing 1114B along the lateral edge 1107. The backing 1114B may, as shown, comprise a rib 1173 with supports 1175 for positioning and supporting the connectors 1111B against and with respect to (the edge 1107 of) the panel 1101. The connectors 1111A, 1111B are arranged laterally aside of the shield panel 1101. The connectors 1111A, 1111B may have a length along an axis of the respective holes 1113A, 1113B equal to the thickness of the panel 1101 but preferably the connectors 1111A, 1111B are longer than that and protrude beyond one or both opposite faces 1103, 1105 of the shield panel 1101. This may extend the screw thread benefitting fixation and/or improving simultaneous connection from opposite sides.

The connector 1171 is generally comprises, like the connectors 511 and 811, connectors 1171A and 1171B on opposite sides of the shield panel 1101, attached to a generally U-shaped connector mounting bracket 1121 and each comprising, as an option, an internally screw threaded hole 1113C.

Figure 13:
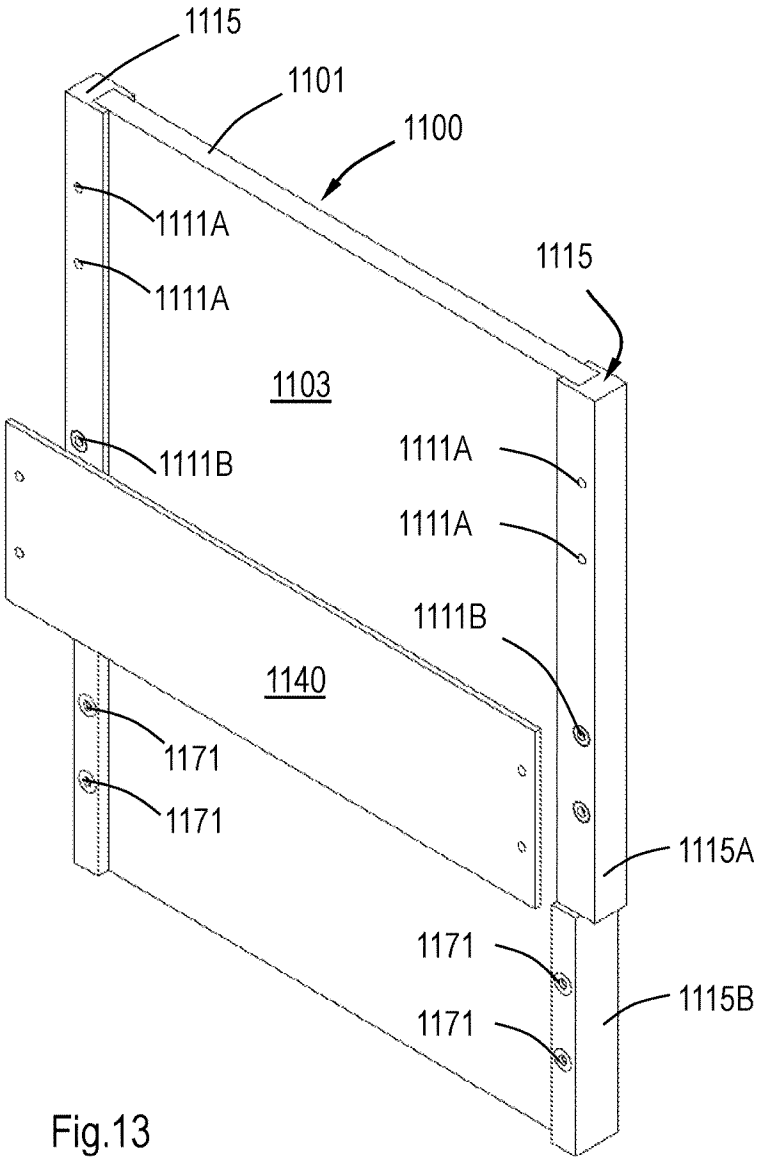
FIG. 13 shows part of a shield body comprising the shield panel and connectors of FIG. 12.
Figure 12:
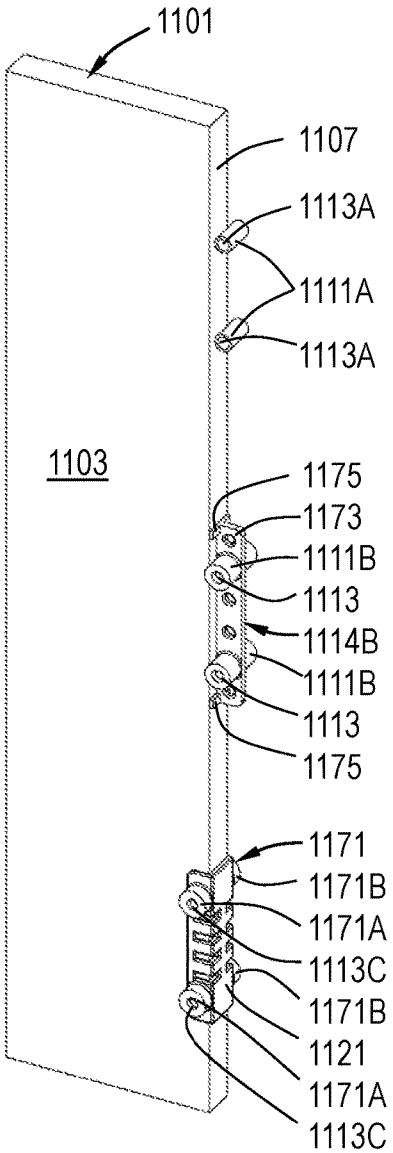
FIG. 12 shows part of a shield panel and different connectors.

FIG. 13 shows a portion of a shield body 1100 comprising the shield panel 1101 and connectors 1111A, 1111B, 1171 of FIG. 12 and provided with an edging 1115, in which the connectors 1111A, 1111B, 1171 are accommodated; see also FIGS. 14A-14D.

In FIG. 13, the shield body 1100 is provided with an expansion bracket 1140 (only schematically shown) for mounting and supporting one or more further accessories on the shield body 1100. As an option, the edging 1115 comprises two differently shaped portions 1115A, 1115B. One edging portion 1115A is wider (lateral direction) and thinner than the other edging portion 1115B. The shape of the edging portions 1115A, 1115B accommodates the connectors 1111A, 1111B, 1171. Also, the shown shape may provide additional support for the expansion bracket 1140 and/or other accessories, thus possibly reducing load on a connector 111B.

Figure 14A:
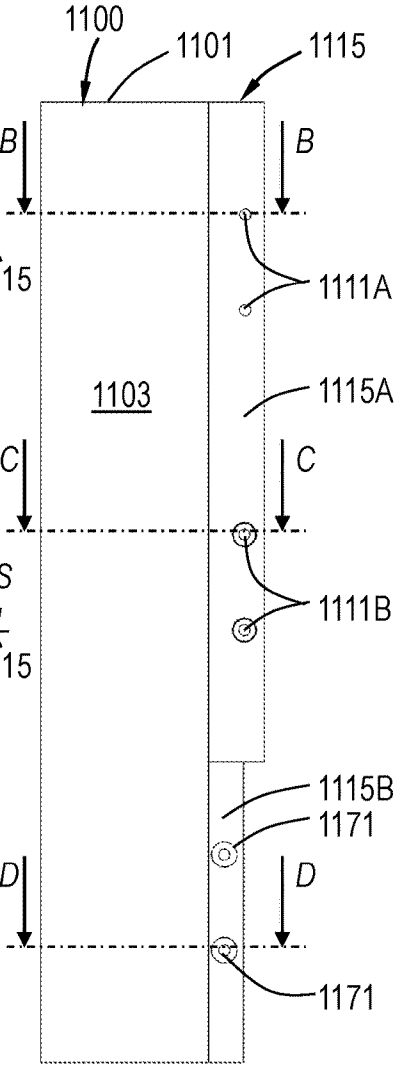
FIGS. 14A-14D show a plan view and cross section views, respectively, of the shield body of FIG. 13.
Figure 14B:
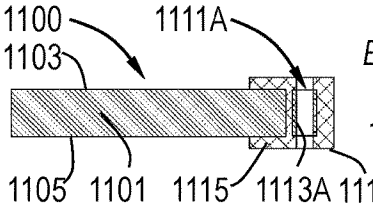
Figure 14C:
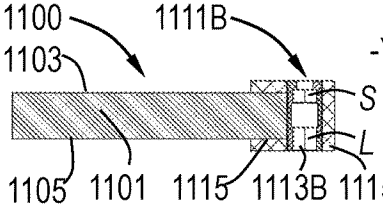
Figure 14D:
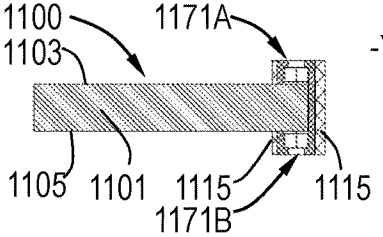

FIGS. 14A-14D show a plan view and cross section views, respectively, of part of the shield 1100 and its edging 1115. FIGS. 14A and 14B show the connector 1111A. FIGS. 14A and 14C show the connector 1111B. In FIG. 14B may be seen that, as an option, the connector 111B may comprise separate screw threaded parts; here, a long section L up to an end of the connector and a short section S at a distance from the nearest connector end, respectively. It is noted that any connector disclosed herein may be asymmetric with respect to a first and second side. FIGS. 14A and 14D show the connector 1171. Here, FIG. 14D shows that the holes 1113 are through holes and that, however, the shield panel 1101 is intact between the holes and devoid of holes itself, at least at and near the connectors. At least one of the holes 1113 may be a blind hole to further protect the panel 1101. Note that also connectors 1111A, 1111B, may comprise one or more (possibly threaded) blind holes on one or both opposite sides of the shield panel 1101, instead of through holes 1113.

Figure 15B:
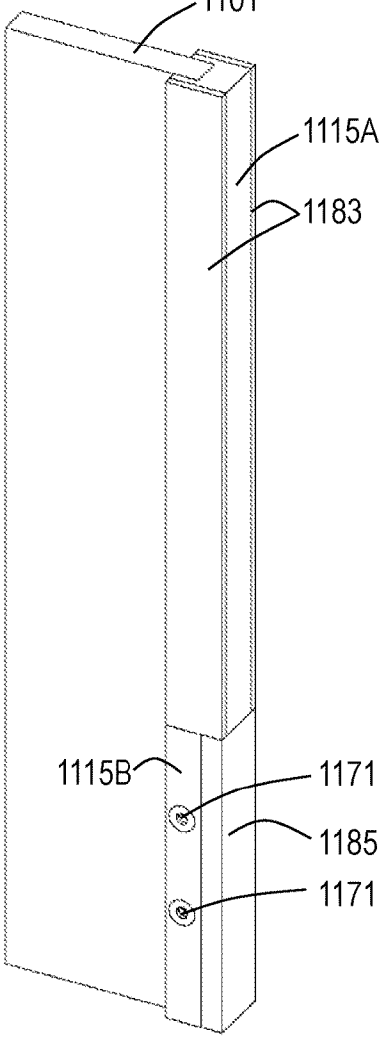
FIGS. 15A-15B indicate method steps of manufacturing the shield of FIG. 13.
Figure 15A:
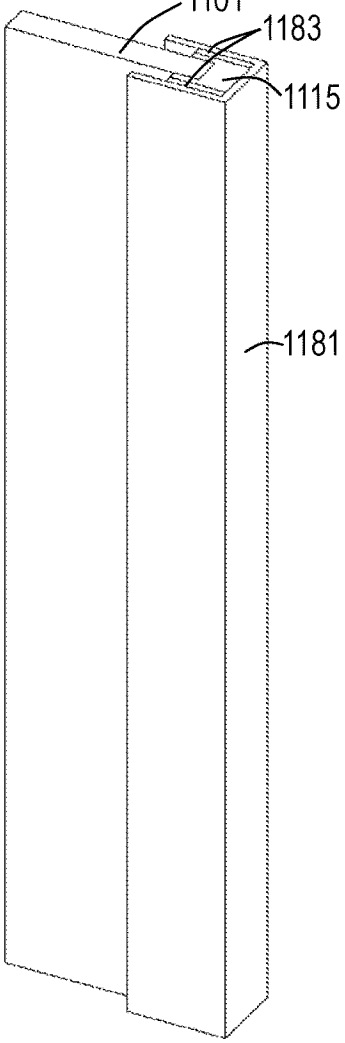

FIGS. 15A and 15B show part of a method of manufacturing the edging 115 of the shield body 1101 of FIGS. 13-14D; the edging 1115 may be formed by overmoulding. For this, a mould 1181 may be employed fit at least partly around the shield panel 1101 and filled with moulding material that forms at least part of the edging 1115, after one or more of hardening, setting, curing, with or without external energy such as heat and/or radiation. The mould 1181 may be suitably shaped and/or be combined with inserts 1183, 1185, to define a mould cavity in turn determining the shape of the edging. However, the edging may also be post-processed such as by cutting, polishing and/or additional covering.

Figures 16A, 16B:
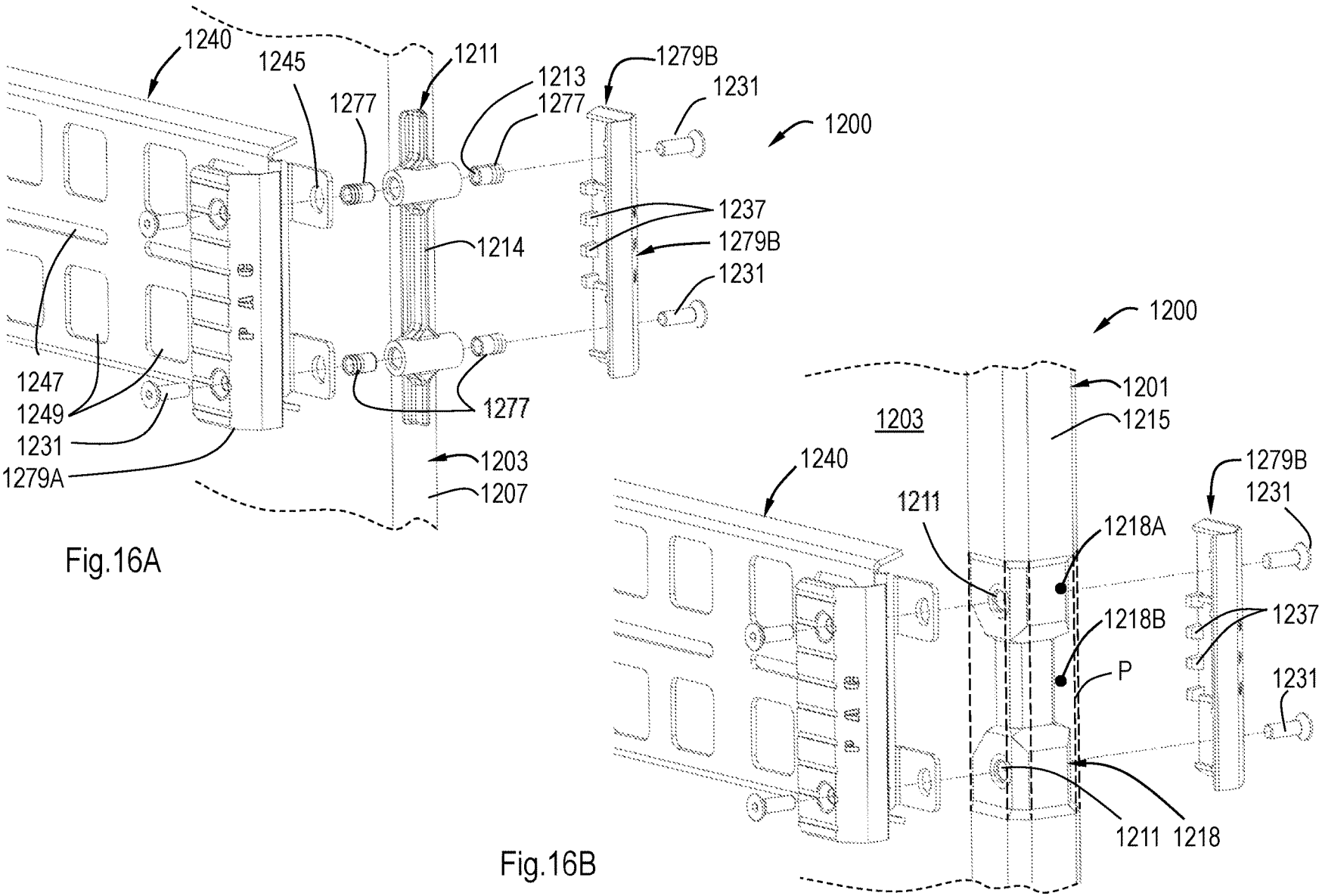
FIGS. 16A-16B indicate part of a shield body, a connector with covers and an expansion bracket.
Figure 17C:
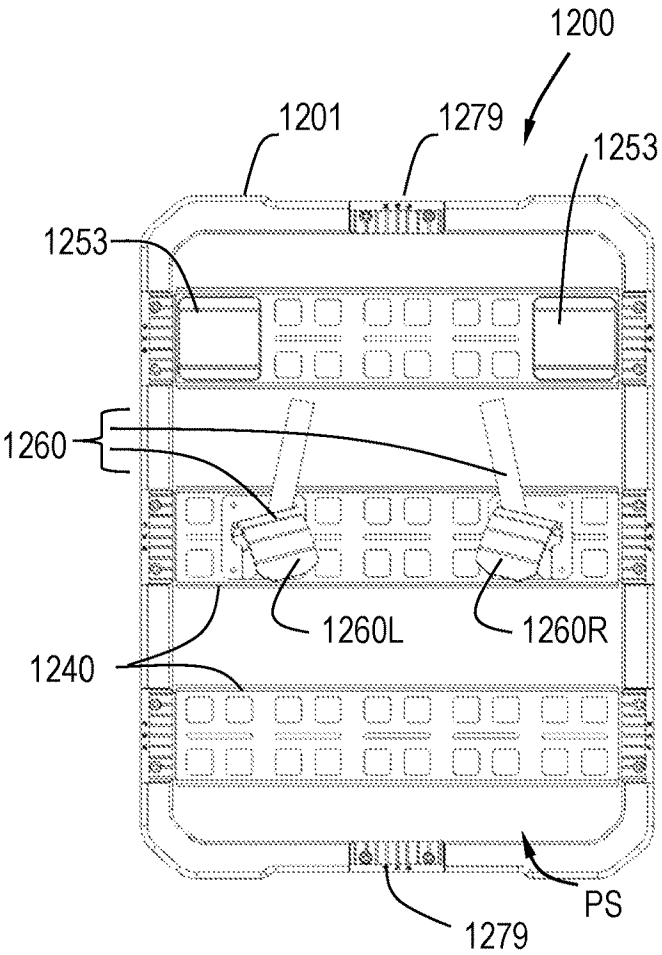
FIGS. 17A-17C show in different views a shield body provided with plural expansion brackets for and supporting further accessories.
Figure 17B:
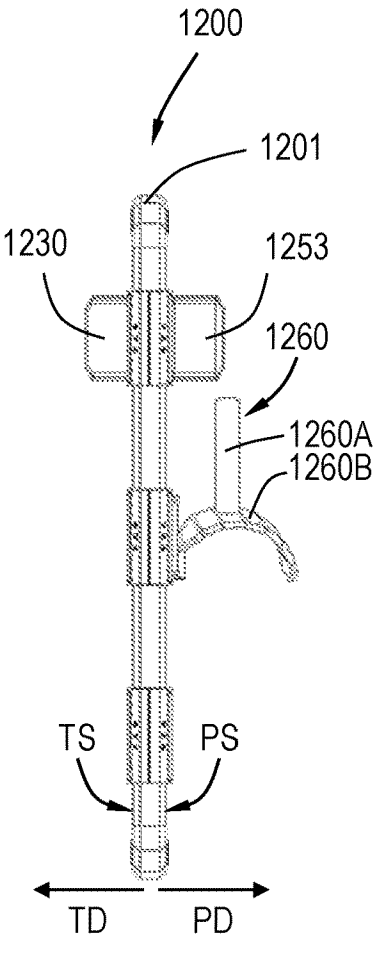
Figure 17A:
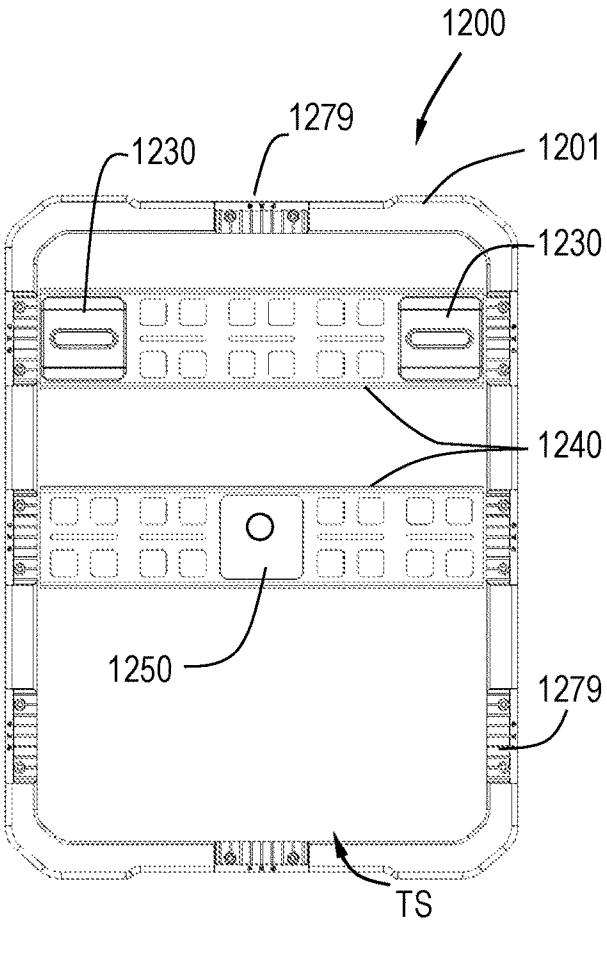

FIGS. 16A-16B show in partly exploded view a connector 1211 of part of a shield 1200 and its edging 1215; FIGS. 17A-17C 17B show the shield 1200 in front, side and back view, respectively.

As before, the shield 1200 comprises a shield body 1201 comprising a shield panel 1203, connectors 1211 and an edging 1215. The connectors 1211 comprise tubular portions like bushes 1277 having internally threaded holes 1213, connected to each other by a backing 1214 along an edge 1207 of the shield panel 1203. The bushes 1277 and backing 1214 may be of different materials e.g. metal bushes 1277 and polymeric backing 1214. The backing 1214 may be overmoulded onto the bushes 1277 for facilitating assembly.

FIGS. 16A-16B further show an expansion bracket 1240 (to be) mounted to the shield body 1201, here using bolts 1231 as fasteners through connection holes 1245 of the expansion bracket 1240. The expansion bracket 1240 comprises further connectors 1247, 1249 here formed as differently shaped holes. In particular, at least part of the further connectors 1247, 1249 may be in accordance with a standardised mounting system such as the MOLLE mounting system.

The connector 1211 with or without the expansion bracket 1240 connected to it, may be covered by an optional cover 1279. Here, the cover 1279 comprises a first and a second portion 1279A, 1279B, respectively. The cover 1279 may be fixed with the fasters 1231, and/or a separate connection and/or it may be snapped onto at least part of the edging; for this latter option, one or both of the cover and the edging may comprise one or more protrusions and the other may comprise matching recesses for receiving the one or more protrusions (not shown).

Here, the edging 1215 comprises an optional recess 1218 having different profiled portions; a first recess portion 1218A having a first depth relative to an edging perimeter P and a second recess portion 1218B having a second depth relative to the edging perimeter P. The recess 1218 may accommodate a cable and/or conduit (not shown).

The (recess 1218 of the) edging 1215 and the cover 1279 may be formed complementary so that the cover 1279, when mounted to the shield body 1201 provides a substantially continuous perimeter of the edging 1215 and therewith of the shield body 1201; see FIGS. 17A-17C. The cover 1279 may comprise one or more structures like teeth 1237A defining at least part of a channel for guiding a cable and/or conduit (not shown) between an accessory on the one side of the shield body 1201 and the other side thereof, such that the cable and/or conduit remain substantially covered and unexposed, compare also with (the accessory portion 832 of) FIGS. 8A-8E.

FIGS. 17A-17C show the shield 1200 being provided with plural expansion brackets 1240 on both the threat side TS (FIG. 17A) and the protected side PS (FIG. 17C). As an option each connection of an expansion bracket 1240 to a shield connector 1211 is provided with a cover 1279. The connectors 1211 to which no expansion brackets 1240 or other accessories are mounted are also provided with covers 1279.

The shield 1200 is provided with optional lights 1230 on the threat side TS and optional batteries 1253 on the protected side PS for powering the lights 1230. The batteries 1253 and lights 1230 may be connected with cables guided through the covers 1279 and supported by the expansion brackets 1240, not shown. As may be discerned in FIGS. 16A-16B, the expansion brackets 1240 may be at least partly hollow facilitating guiding a cable or conduit between the expansion bracket 1240 and the shield panel 1203. Further accessories may be mounted to the expansion brackets, e.g. a camera 1250 or other sensor. One or more of the accessories and/or further accessories may be mounted to different expansion brackets 1240, e.g. for balancing the shield 1200.

On the protected side PS a carrying support 1260 for carrying the shield 1200 is mounted to an expansion bracket 1240. As an option the carrying support 1260 comprises a hand grip 1260A and an arm rest 1260B. Here, the carrying support 1260 comprises plural support members 1260L, 1260R that may be identical or different and which here are mirror images of each other. The disclosure is not restricted to the above described embodiments which can be varied in any number of ways within the scope of the claims.

E.g., at least some connectors and/or accessories may be used for permanent mounting. Also or alternatively, not shown, at least some connectors and/or accessories (e.g. mounting brackets) may be used to interconnect several shields together to increase protective surface area. Also or alternatively, a connector may be formed as a rail providing plural mounting positions, e.g. substantially continuously adjustable mounting positions, e.g. having a general U- or C-shape for attachment of counterconnector comprising a mated rail nut portion and/or fixable slider-portion received in the rail, or the connector may comprise a general T-shaped rail portion to be accommodated into a U- or C-shaped counterconnector. Such rail may be provided with protrusions or recesses to define predetermined mounting positions along the rail.

Elements and aspects discussed for or in relation with a particular embodiment may be suitably combined with elements and aspects of other embodiments, unless explicitly stated otherwise.

The invention claimed is:

1. A protective shield body comprising
   - a shield panel having a first and second face defining a threat side in a threat direction (TD) and a protected side in a protected direction (PD) opposite the threat side and threat direction, respectively, and having opposite lateral panel edges;
   - an edging covering at least part of the panel edges;
   - connectors configured to mount one or more accessories to the shield body on the threat side, wherein at least some of the connectors are arranged —on the threat side and/or at least one of exposed and exposable on the threat side, and —at least partly accommodated in the edging; and
   - wherein the panel is devoid of holes into and/or through the panel associated with a connector and/or attachment of a connector.

2. The shield body according to claim 1, comprising additional connectors configured to removably mount one or more accessories to the shield body on the protected side, being arranged
   - on the protected side and/or at least one of exposed and exposable on the protected side, and
   - being at least partly accommodated in the edging.

3. The shield body according to claim 1, wherein at least some of the connectors are arranged at or near opposite panel edges.

4. The shield body according to claim 1, wherein a plurality of the connectors is substantially identical.

5. The shield body according to claim 1, wherein at least some of the connectors comprise a threaded portion for a screw connection and/or bayonet connection with a mated screw counterconnector and/or bayonet counterconnector.

6. The shield body according to claim 1, wherein a plurality of the connectors is attached to each other as, and/or integrated into, an object attached to the panel and to the edging.

7. The shield body according to claim 1, wherein at least part of at least some of the connectors is formed as a rail.

8. The shield body according to claim 1, wherein a plurality of the connectors on and/or towards the threat side and connectors on and/or towards the protected side are in register with each other in a direction normal to the first face and/or the second face of the panel.

9. A protective shield body comprising:

a shield panel having a first and second face defining a threat side in a threat direction (TD) and a protected side in a protected direction (PD) opposite the threat side and threat direction, respectively, and having opposite lateral panel edges;

an edging covering at least part of the panel edges;

connectors configured to mount one or more accessories to the shield body on the threat side, and wherein at least some of the connectors are arranged on the threat side and/or at least one of exposed and exposable on the threat side, and at least partly accommodated in the edging; and at least one cable extending from the protected side to the threat side along an edge of the panel for transferring power and/or a signal such as a sensor signal between the protected side and the threat side, and/or at least one conduit extending from the protected side to the threat side along an edge of the panel for transferring a fluid such as a liquid or a gas between a fluid supply on the protected side and a fluid outlet on the threat side, wherein the at least one cable and/or the at least one conduit, respectively, is at least partly accommodated in the edging and/or in a connector.

10. The shield body according to claim 1, wherein a connector or a group of connectors defines a recess in a direction parallel to the first and/or second face forming a partly enclosed channel extending from the protected side to the threat side for accommodating an object in the channel and sideways receiving the object into the channel.

11. The shield body according to claim 9, wherein the edging comprises an overmoulded portion, wherein the connectors are at least partly accommodated in and fixed by the overmoulded portion of the edging, and, wherein the at least one cable and/or the at least one conduit, respectively, are at least partly accommodated in and fixed by the overmoulded portion of the edging.

12. The shield body according to claim 1, comprising one or more accessories to the shield body mated to and/or comprising mating counterconnectors for mounting the one or more accessories to the shield body.

13. The shield body according to claim 12, wherein the one or more accessories comprises an expansion bracket configured to support one or more further accessories and provided with one or more counterconnectors mated to a connector of the shield body, wherein the expansion bracket comprises one or more mounting connectors configured to mount the one or more further accessories to the expansion bracket the expansion bracket.

14. The shield body according to claim 12, wherein the one or more accessories comprise at least one of:

a light source;

a loudspeaker;

a visual indicator, such as indicia, light banner, display, etc.;

a sensor;

a recording device for one or more sensor signals and/or written information;

a projectile projector;

an electric shocking device;

a substance projector;

a sharp weapons device;

a power source;

an ammunition holder;

a baton holder;

a handcuff holder;

a supplementary ballistic panel holder;

a carrying support; and a wheel and/or set of wheels.

15. The shield body according to claim 1, comprising one or more accessories mounted to the shield body.

16. The shield body according to claim 1, comprising one or more accessories mounted to the shield body mated to and/or comprising mating counterconnectors for removably mounting the one or more accessories to the shield body.

17. The shield body of claim 13, wherein the one or more mounting connectors configured to mount the one or more further accessories to the expansion bracket the expansion bracket traverse the shield body from at least one of the connectors at or near one panel edge to at least one other one of the connectors on a laterally opposite panel edge.

18. The shield body according to claim 1, wherein a plurality of the connectors is attached to each other as, and/or integrated into, an object attached to the panel and to the edging being formed as or connected by a strip along at least part of the edges.

19. A protective shield body comprising:

a shield panel having a first and second face defining a threat side in a threat direction (TD) and a protected side in a protected direction (PD) opposite the threat side and threat direction, respectively, and having opposite lateral panel edges;

an edging covering at least part of the panel edges;

connectors configured to mount one or more accessories to the shield body on the threat side, and wherein at least some of the connectors are arranged on the threat side and/or at least one of exposed and exposable on the threat side, and at least partly accommodated in the edging; and wherein the edging comprises an overmoulded portion, wherein the connectors are at least partly accommodated in and fixed by the overmoulded portion of the edging.

20. The shield body according to claim 19, wherein the panel is devoid of holes into and/or through the panel associated with a connector and/or attachment of a connector.

* * * * *